US005771025A

United States Patent [19]

Reece et al.

[11] Patent Number: 5,771,025

[45] Date of Patent: Jun. 23, 1998

[54] FOLDED MONO-BOW ANTENNAS AND ANTENNA SYSTEMS FOR USE IN CELLULAR AND OTHER WIRELESS COMMUNICATION SYSTEMS

[75] Inventors: John Kenneth Reece; John L. Aden, both of Colorado Springs, Colo.

[73] Assignee: Omnipoint Corporation, Colorado Springs, Colo.

[21] Appl. No.: 673,871

[22] Filed: Jul. 2, 1996

[51] Int. Cl.[6] ..... H01Q 1/38; H01Q 9/38

[52] U.S. Cl. ..... 343/828; 343/830; 343/846; 343/853; 343/789

[58] Field of Search ..... 343/828, 795, 343/700 MS, 803, 829, 830, 833, 846, 853, 789; 333/120, 121; H01Q 9/38, 1/38

[56] References Cited

U.S. PATENT DOCUMENTS 4,218,684 8/1980 Ellis ..... 343/789
4,218,685 8/1980 Ellis, Jr. ..... 343/727
4,414,550 11/1983 Tresselt ..... 343/700 MS
4,425,567 1/1984 Tresselt ..... 342/373
4,860,019 8/1989 Jiang et al. ..... 343/795
5,506,592 4/1996 MacDonald et al. ..... 343/795

*Primary Examiner*—Michael C. Wimer
*Attorney, Agent, or Firm*—Lyon & Lyon LLP

[57] ABSTRACT

Improved antennas and antenna systems for use in cellular and other wireless communications systems. A folded mono-bow antenna element is provided which has a substantially omnidirectional radiation pattern in a horizontal plane and shows variation in gain in an elevation plane depending upon the size of an associated ground plane. The folded mono-bow antenna element comprises a main bowtie radiating element and parasitic element wherein the main bowtie radiating element and parasitic element are separated by a dielectric material having a dielectric constant preferably less than 4.5 and, in some cases, less than or equal to 3.3. Various antenna arrays and methods of making the same are also provided.

46 Claims, 21 Drawing Sheets

FOLDED MONO-BOW ANTENNAS AND ANTENNA SYSTEMS FOR USE IN CELLULAR AND OTHER WIRELESS COMMUNICATION SYSTEMS

BACKGROUND OF THE INVENTION

The present invention pertains generally to the field of antennas and antenna systems including, more particularly, antennas and antenna systems for use in cellular and other wireless communications systems.

While substantial recent attention has been directed to the design and implementation of cellular and other wireless communications systems and to the communications protocols utilized by those systems, surprisingly little attention has been directed to the development of improved antennas and antenna systems for use within those communications systems.

Perhaps, the reason for this is that until recently space for the deployment of antenna networks was readily available on the tops of buildings in a dense urban environment. Thus, until recently little attention was paid to the development of relatively small, aesthetically appealing antenna networks which could be deployed, for example, on light poles or telephone poles substantially at street level. Nor was there any substantial reason, until recently, to address the issue of channeling in the "urban canyon." The term, "urban canyon," as used herein, refers to the linear open space which exists between buildings along streets, for example, in a dense urban environment. As for the issue of channeling within an urban canyon, it has been found that the exterior surfaces (walls and the like) of the buildings lining an urban canyon exhibit characteristics quite similar to the walls of a typical wave guide. Thus, when a radio frequency (RF) signal is transmitted within an urban canyon, the signal tends to propagate for the entire length of the urban canyon with very little attenuation. While this characteristic of an urban canyon may be viewed by some as advantageous, this characteristic raises a serious issue when it is desired to implement a cellular communications network within a dense urban environment. In short, this characteristic makes it difficult for mobile units and base stations alike to identify differences in the strengths of received signals, thus, making it difficult to effect necessary and proper hand-offs between and among the mobile units and base stations. To better understand this principle, one should consider a scenario where a mobile unit enters a four-way intersection within a dense urban environment (i.e., when a mobile unit reaches the intersection point of two urban canyons). Upon entering the intersection, the mobile unit is likely to receive four separate signals of substantially the same amplitude from four separate base stations, and the base stations are likely to receive signals of similar amplitude from the mobile unit. This presents a substantial risk that the mobile unit will be handed-off to an improper base station and, as a result, communications between the mobile unit and the base stations will be terminated prematurely (i.e., the call may be lost).

Another issue which must be addressed in the design of antenna networks for use in "low tier," or street level, deployment schemes is the issue of "multipath" interference. The term "multipath" refers to the tendency of an antenna in a dense urban environment (or any other environment) to receive a single (or the same) signal multiple times as the signal is reflected from objects (poles, buildings and the like) in the area proximate the antenna. To combat multipath interference, it may be desirable to employ one or more pattern or separation diversity methodologies within a given antenna network.

Given the substantial issues of channeling, multipath, size and aesthetics which must be addressed when designing antennas and antenna networks for low tier deployment within a dense urban (or other) environment, it is believed that those skilled in the art would find improved antennas and antenna networks which may be deployed in relatively small, aesthetically appealing packages, and which may provide substantial multipath and channeling mitigation, to be very useful.

SUMMARY OF THE INVENTION

The present invention is directed to the implementation, manufacture and use of improved antenna elements and antenna arrays for use in cellular and other wireless communications systems. The antennas and antenna arrays of the present invention may be deployed in relatively small, aesthetically appealing packages and, perhaps more importantly, may be utilized to provide substantial mitigation of multipath and channeling in a dense urban (or other) environment.

In one innovative aspect, the present invention is directed to the implementation, manufacture and use of a folded mono-bow antenna element. A folded mono-bow antenna element in accordance with the present invention may comprise, for example, a main radiating bowtie element and a parasitic element, wherein the main radiating bowtie element and the parasitic element are separated by a dielectric material and, if desired, may be formed on separate sides of a dielectric substrate, such as a printed circuit board. A shorting element may also provide an electrical connection between a selected portion of the main radiating bowtie element and a selected portion of the parasitic element. The main radiating bowtie element may be coupled to a feed pin mounted through an insulated hole formed in an associated ground plane, and the parasitic element may be mounted to the ground plane. A folded mono-bow antenna in accordance with the present invention may have a substantially omnidirectional radiation pattern in the horizontal plane, a radiation pattern which varies in the elevation plane depending upon the size of an associated ground plane, and may be dimensioned to provide transmission and reception over a fairly broad bandwidth centered, for example, at a frequency of 1920 MHZ. This makes the folded mono-bow antenna of the present invention quite suitable for use in cellular and other wireless communications systems.

In one innovative arrangement, a pair of folded mono-bow antennas (or other monopole antennas) may be configured to provide a dual pattern diversity folded mono-bow array. In such an embodiment, two folded mono-bow antenna elements (or other monopole antenna elements) may be mounted on a common ground plane and fed by a 180° ring hybrid combiner/splitter circuit. By combining a pair of folded mono-bow antenna elements in this fashion, it is possible to achieve a radiation pattern which exhibits reduced azimuth beam width orthogonal beam pairs. Thus, a dual pattern diversity folded mono-bow antenna array in accordance with the present invention is particularly well suited for use with communications systems which utilize pattern diversity to mitigate multipath.

In another innovative arrangement, four of the aforementioned dual pattern diversity folded mono-bow arrays may be configured to provide a dual polarized 4-way diversity antenna array. In such an embodiment, the ground planes of the respective dual pattern diversity folded mono-bow arrays may be arranged such that selected pairs of the ground planes form parallel and opposing surfaces, and such that adjacent pairs of the ground planes have an orthogonal relationship to one another.

In still another innovative arrangement, four folded mono-bow antenna elements (or other monopole antenna elements) may be configured to provide a 4-beam monopole diversity antenna array. In such an embodiment, four folded mono-bow antenna elements may be mounted on a common ground plane along a common axis and fed by a butler matrix combiner.

In still another innovative arrangement, two folded mono-bow antenna elements may be configured to provide an omnidirectional dual pattern diversity antenna array. In such an embodiment, a pair of folded mono-bow antenna element may be coupled to a 180° hybrid combiner network and oriented along a common axis in contra-direction to one another.

Accordingly, it is an object of one aspect of the present invention to provide improved antenna elements for use in cellular and other wireless communications systems. It is another object of an aspect of the present invention to provide improved antennas and antenna arrays for use in cellular and other wireless communications systems.

It is still another object of an aspect of the present invention to provide improved antennas and antenna networks which may provide substantial mitigation of multipath and channeling in a dense urban (or other) environment.

It is still another object of an aspect of the present invention to provide improved methods for manufacturing antennas and antenna arrays for use in cellular and other wireless communications systems.

It is still another object of an aspect of the present invention to provide improved methods for using antennas and antenna systems within cellular and other wireless communications systems.

These and other objects, features and advantages will be more clearly understood from the following detailed description taken in conjunction with the accompanying drawings.

BRIEF DESCRIPTION OF THE DRAWINGS

FIG. 1(*b*) is a frontal view of the folded mono-bow antenna illustrated in FIG. 1(*a*).

FIG. 1(*c*) is a back view of the folded mono-bow antenna illustrated in FIG. 1(*a*).

FIG. 2(*b*) is an illustration of a parasitic element formed on a second side of a printed circuit board substrate in accordance with a preferred form of the present invention.

FIG. 4(*b*) is an illustration of a combiner/ splitter circuit utilized in a preferred form of a dual pattern diversity folded mono-bow antenna array. 3(*a*).

FIG. 4(*c*) illustrates the layout of the metal traces forming the combiner/splitter circuit shown in FIG. 4(*b*).

FIG. 4(*d*) is an illustration of an alternative layout for the combiner/splitter circuit of FIG. 4(*b*).

FIG. 4(*e*) is an illustration of one side of a ground plane.

FIG. 4(*f*) is an illustration of one embodiment of a dual pattern diversity folded mono-bow antenna array with opposite facing elements.

FIG. 4(*g*) is an illustration of an exploded view of the mono-bow antenna array of FIG. 4(*f*).

FIG. 4(*h*) is an illustration of an exploded view of an antenna embodying aspects of the present invention.

FIG. 7(*b*) is an illustration of a butler matrix utilized in the 4-beam monopole diversity antenna array illustrated in FIG. 7(*a*).

FIG. 7(*c*) shows the preferred dimensions of the metal traces forming the butler matrix circuit illustrated in FIG. 7(*b*).

DESCRIPTION OF PREFERRED EMBODIMENTS

Figure 1A:
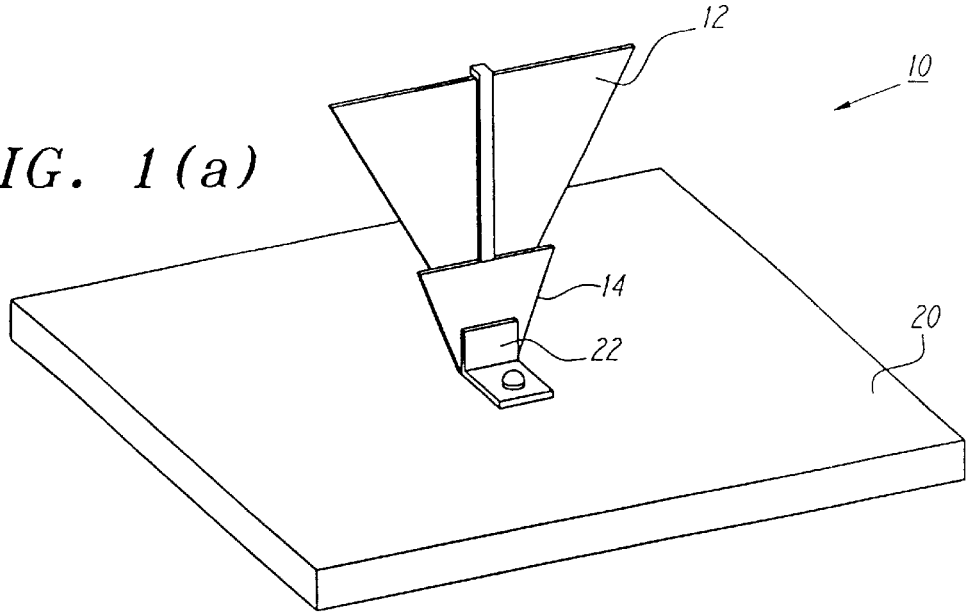
FIG. 1(*a*) is an illustration of a folded mono-bow antenna in accordance with the present invention.

In an effort to highlight various embodiments and innovative aspects of the present invention, a number of subheadings are provided in the following discussion. Further, where a given structure appears in several drawings, that structure is labeled using the same reference numeral in each drawing.

Folded Mono-Bow Antenna Elements

Figure 1B:
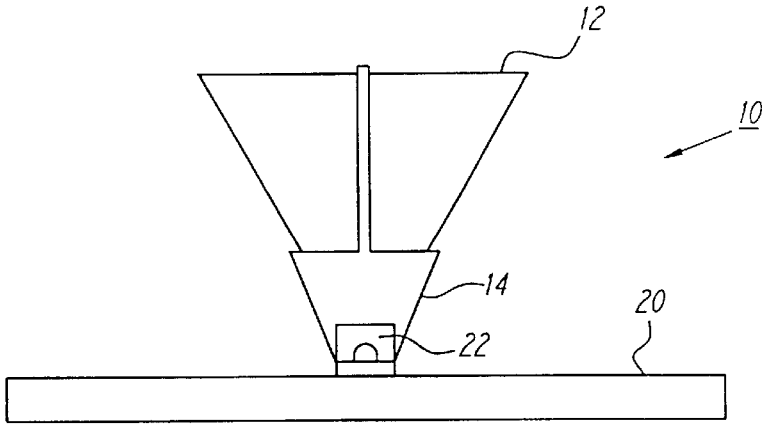
Figure 1C:
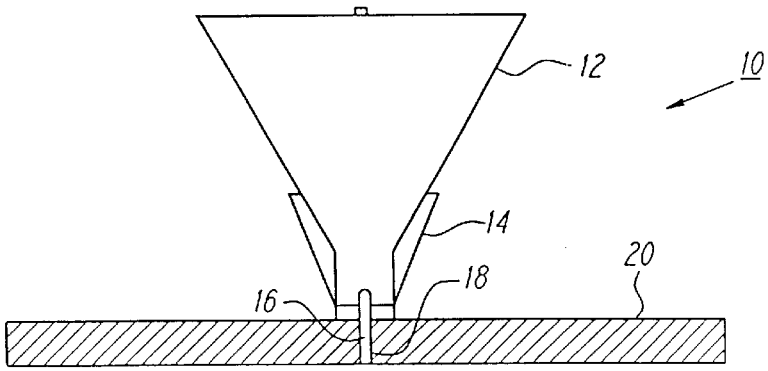

Turning now to the drawings, in one innovative aspect the present invention is directed to the implementation of a folded mono-bow antenna element 10 and to methods of manufacturing and using the same. As shown in FIGS. 1(*a*)–1(*c*), a folded mono-bow antenna element 10 comprises a large bowtie radiating element 12, which provides the primary means of power transfer and impedance matching for the antenna 10, and a smaller grounded parasitic element 14, which provides a capacitive matching section for the input impedance of the antenna 10. The main bowtie radiating element 12 is mounted to a feed pin 16, which extends through an insulated hole 18 formed in an associated ground plane 20, and the parasitic element 14 is preferably mounted to a brass angle 22 which, in turn, is coupled to the ground plane 20. In a preferred form, the insulated hole 18 has a diameter of substantially 0.160 inches, and the feed pin 16 has a diameter of 0.050 inches.

Figure 2A:
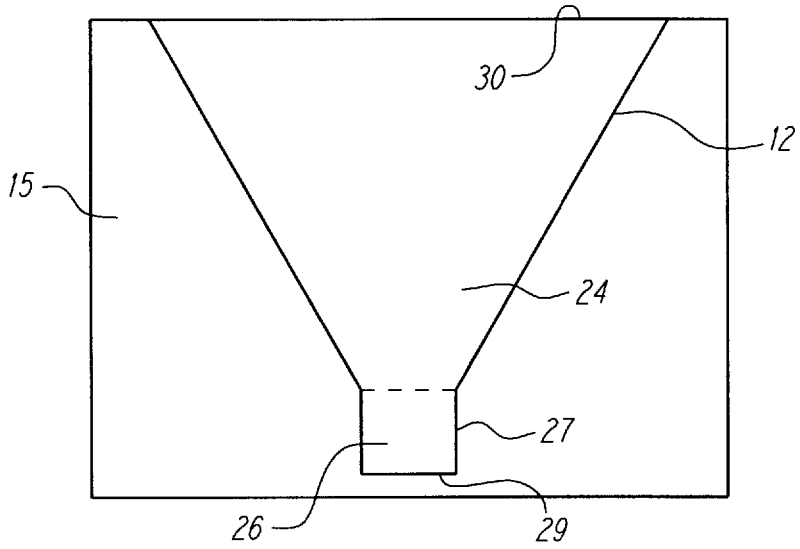
FIG. 2(*a*) is an illustration of a main bowtie radiating element formed on a first side of a printed circuit board substrate in accordance with a preferred form of the present invention.
Figure 2B:
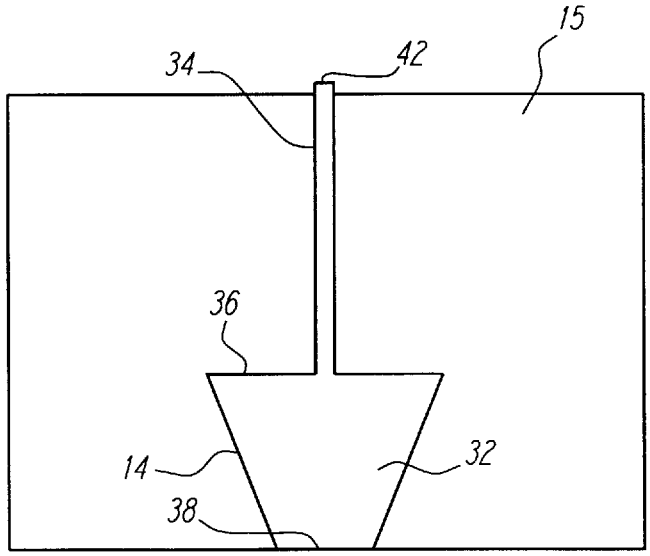

Turning now also to FIGS. 2(*a*) and 2(*b*), in a preferred form the main bowtie radiating element 12 and the parasitic element 14 are separated by a dielectric material 15 (e.g., air or some other dielectric material) having a dielectric constant which is preferably less than or equal to 4.5. Further, while the shape and dimensions of the main bowtie radiating element 12 and parasitic element 14 may vary depending upon the operational characteristics desired for a particular application, it is presently preferred that the main bowtie radiating element 12 comprise two sections, a main radiating section 24 having a substantially symmetric trapezoidal shape and a pin coupling section 26 having a substantially rectangular shape. Further, as shown in FIG. 2(*a*), it is presently preferred that the main bowtie radiating element 12 have a height $H_{MRE}$ substantially equal to 1.070 inches, that an upper edge 30 of the main bowtie radiating element 12 have a length substantially equal to 1.070 inches, and that the pin coupling section 26 of the main bowtie radiating element 12 have parallel side edges 27 measuring substantially 0.145 inches in length and a bottom edge 29 measuring substantially 0.200 inches in length.

As for the parasitic element 14, it is presently preferred that the parasitic element 14 also comprise two sections, a parasitic section 32 having a substantially symmetric trapezoidal shape and a shorting section 34 having a substantially rectangular shape. Moreover, it is presently preferred that the parasitic section 32 have an upper edge 36 measuring substantially 0.600 inches in length, a lower edge 38 measuring substantially 0.175 inches in length and a height $H_{PS}$ substantially equal to 0.475 inches, that the shorting section 34 have a width $W_{SS}$ substantially equal to 0.050 inches and a height $H_{SS}$ substantially equal to 0.625 inches, and that an upper tip portion of the shorting section 34 be electrically coupled via a cap 42 or other means such as, for example, a metal trace or plated through hole, to a central portion of the upper edge 30 of the main radiating section 24 of the main bowtie radiating element 12.

Finally, with regard to the dielectric material 15 and the manufacture of a folded mono-bow antenna element 10, it is presently preferred that the dielectric material 15 comprise a section of printed circuit board constructed from woven TEFLON®, that the dielectric material 15 have a thickness of substantially 0.062 inches, and that the dielectric material 15 have an epsilon value (or dielectric constant) between approximately 3.0 and 3.3. Moreover, it will be appreciated that a folded mono-bow antenna element 10 may be and is preferably manufactured by depositing copper cladding in a conventional manner over opposite surfaces (not shown) of a printed circuit board, and etching portions of the copper cladding away to form the main bowtie radiating element 12 and parasitic element 14.

Figure 3:
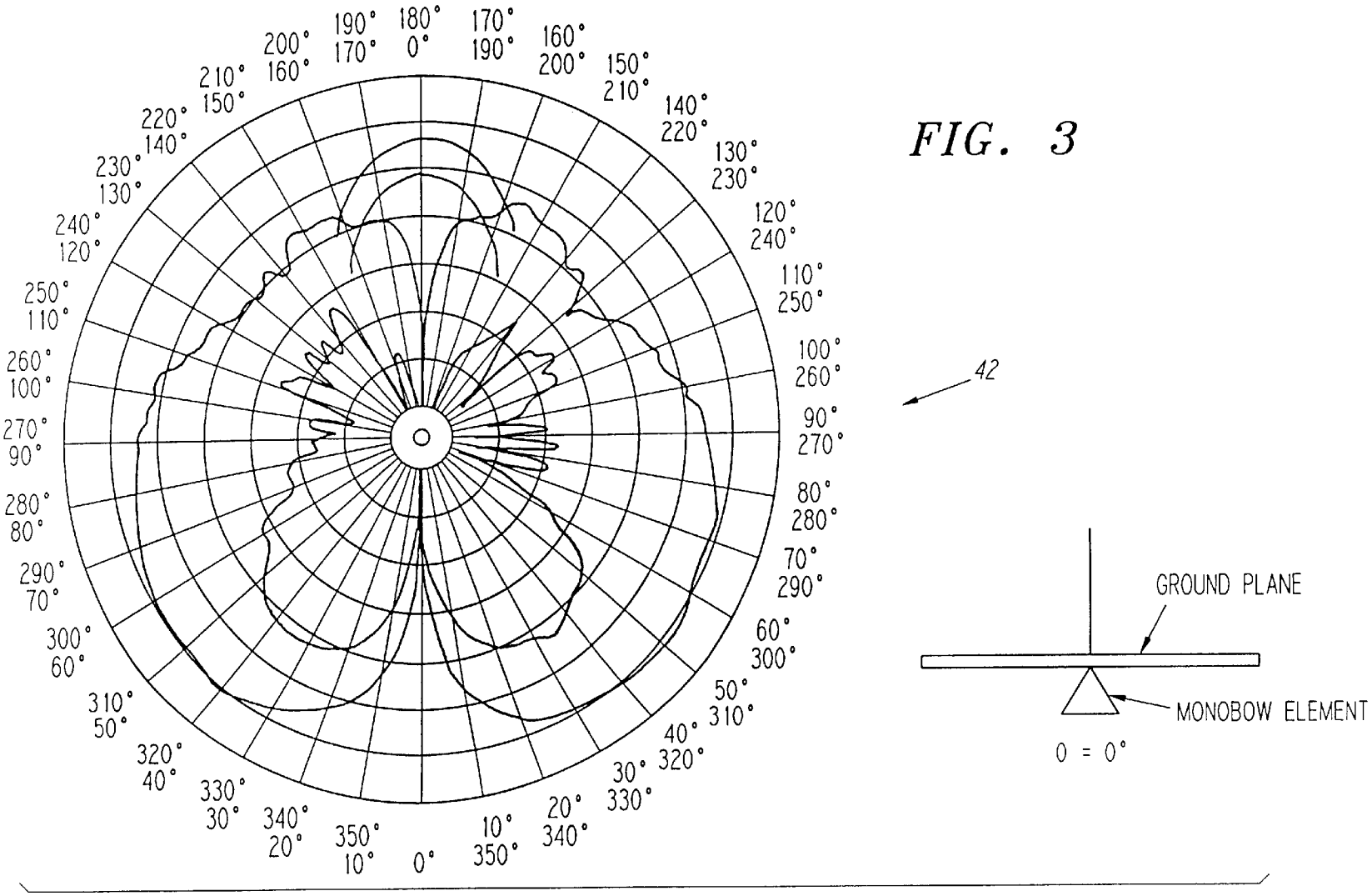
FIG. 3 provides an exemplary illustration of a radiation pattern in an elevation plane of a folded mono-bow antenna in accordance with the present invention.

Turning also to FIG. 3, the radiation pattern 42 of a folded mono-bow antenna element 10 in accordance with the present invention is substantially omnidirectional in $\phi$ (i.e., in the horizontal plane), has nulls at $\Theta$=0° and 180°, and with a ground plane measuring 4.0 inches by 4.0 inches, shows gain at $\Theta$=50° and 310° in the elevation plane. However, it will be appreciated that the shape of the radiation pattern in the elevation plane will vary depending upon the size and shape of the ground plane 20.

Further, when dimensioned as described above, a folded mono-bow antenna element 10 may be configured for optimal transmission and reception at a frequency of substantially 1920 MHZ, and may also provide adequate operational characteristics for transmission and reception in a frequency band between 1710 MHZ and 1990 MHZ.

Dual Pattern Diversity Antenna Arrays

Turning now to FIGS. 4(*a*)–4(*c*), in another innovative aspect the present invention is directed to the implementation, manufacture and use of dual pattern diversity antenna arrays. As shown in FIG. 4(*a*), a dual pattern diversity folded mono-bow antenna array 44 may comprise a pair of folded mono-bow antenna elements 10*a* and 10*b*, a common ground plane 46, and a 180° ring hybrid combiner/splitter circuit 48 (shown in FIGS. 4(*b*) and 4(*c*)).

In a preferred form, the common ground plane 46 may comprise a printed circuit board substrate having opposing coplanar surfaces (i.e. a top surface and a bottom surface) whereon respective layers of copper cladding are deposited, and the 180° ring hybrid combiner/splitter circuit 48, shown in FIGS. 4(*b*) and 4(*c*), may be formed by etching away portions of the copper cladding deposited on one of the surfaces of the printed circuit board substrate. In addition, the copper cladding layer deposited upon the top surface of the printed circuit board substrate and portions of the copper cladding layer deposited on the bottom surface of the printed circuit board substrate (not including those portions of the copper cladding layer which comprise the 180° hybrid combiner/splitter circuit 48) may be electrically connected by a series of plated through-holes 49 formed in the printed circuit board substrate. This may be done to insure that the respective copper cladding layers form a single, unified ground plane. The presently preferred dimensions of the metal traces forming the 180° ring hybrid combiner/splitter circuit 48 shown in FIG. 4(*c*) are as follows. For line segment A-B, 0.5786 inches. For line segment B-C, 0.089 inches. For line segment C-D, 0.386 inches. For line segment D-E, 0.089 inches. For line segment E-F, 0.5786 inches. For line segment F-G, 0.771. For line segments G-H and J-K, 0.1 inches. For line segments H-I and I-K, 0.771 inches. For line segments L-K and H-N, 0.879 inches. For line segments L-M and N-O, 0.4855 inches. The presently preferred line widths for line segments B-B, B-C, C-D, D-E, E-F, F-G, G-I, and I-J is 0.031 inches and 0.058 for the remaining line widths. It is presently preferred to couple the sum and difference ports 50*b* and 50*a* of the 180° ring hybrid combiner/splitter circuit 48 to standard type N coax connectors 71 preferably sized to receive 0.875 inch (⅞") cable.

In a most presently preferred alternative embodiment shown in FIG. 4(*d*), the sum and difference ports 50*b* and 50*a* are not brought to the edge of the ground plane using metal traces. Instead, metal pads are preferably plated close to the combiner splitter circuit and wires 70 are bonded to those pads connecting the coax connectors 71 to the sum and difference ports. (FIG. 4(*e*)).

Turning back to FIG. 4(*a*), the folded mono-bow antenna elements 10*a* and 10*b* may be mounted along a central axis 47 of the common ground plane 46 and should be separated by a distance substantially equal to 0.5 $\lambda$ to 0.7 $\lambda$ of the radio frequency waves to be transmitted and received by the antenna array 44. The elements are shown mounted with an angle bracket 21 and a fastener 22 contiguous with the parasitic element 14. As it is presently preferred that the folded mono-bow antenna elements 10*a* and 10*b* provide for optimal transmission and reception at a frequency of 1920 MHZ, the folded mono-bow antenna elements 10*a* and 10*b* are, preferably, separated by a distance of substantially 3.1 to 4.3 inches. It is also presently preferred that the common ground plane 46 be substantially rectangular in shape, have a width of substantially 6.0 inches and have a length of substantially 8.0 inches. However, it should be appreciated that by varying the dimensions of the common ground plane 46 it is possible to vary the radiation pattern of the antenna array 44 to meet (or attempt to meet) the system design goals of a given installation site. Moreover, depending upon the design goals of a given installation, it may be desirable to modify the dimensions of the ground plane 46, the spacing of the elements, the dimensions of the folded mono-bow antenna elements 10*a* and 10*b* or, perhaps, in some circumstances to substitute some other type of antenna (for example, another type of monopole antenna) for the antenna elements 10*a* and 10*b* described above.

Figure 4A:
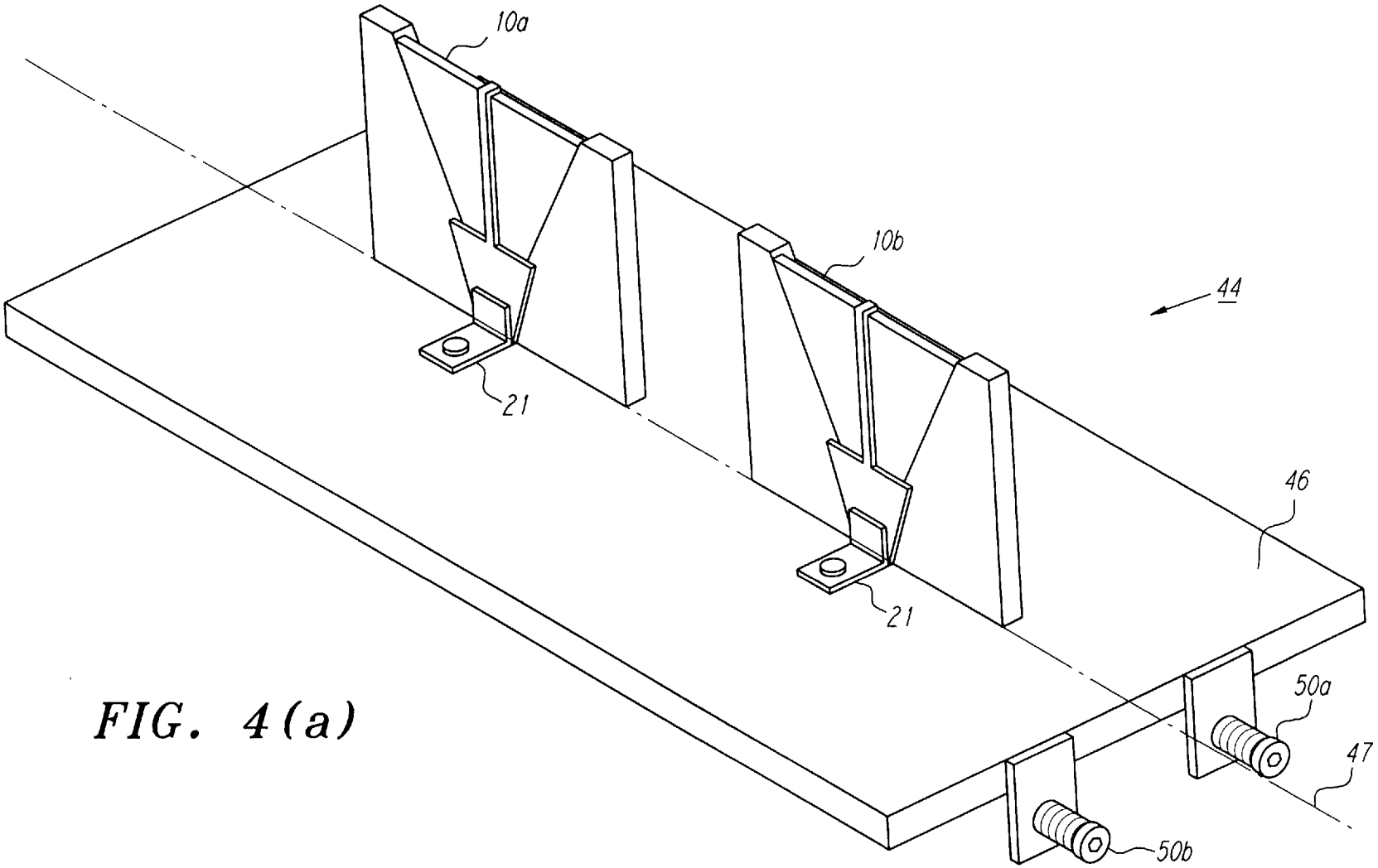
FIG. 4(*a*) is an illustration of a dual pattern diversity folded mono-bow antenna array.
Figure 4B:
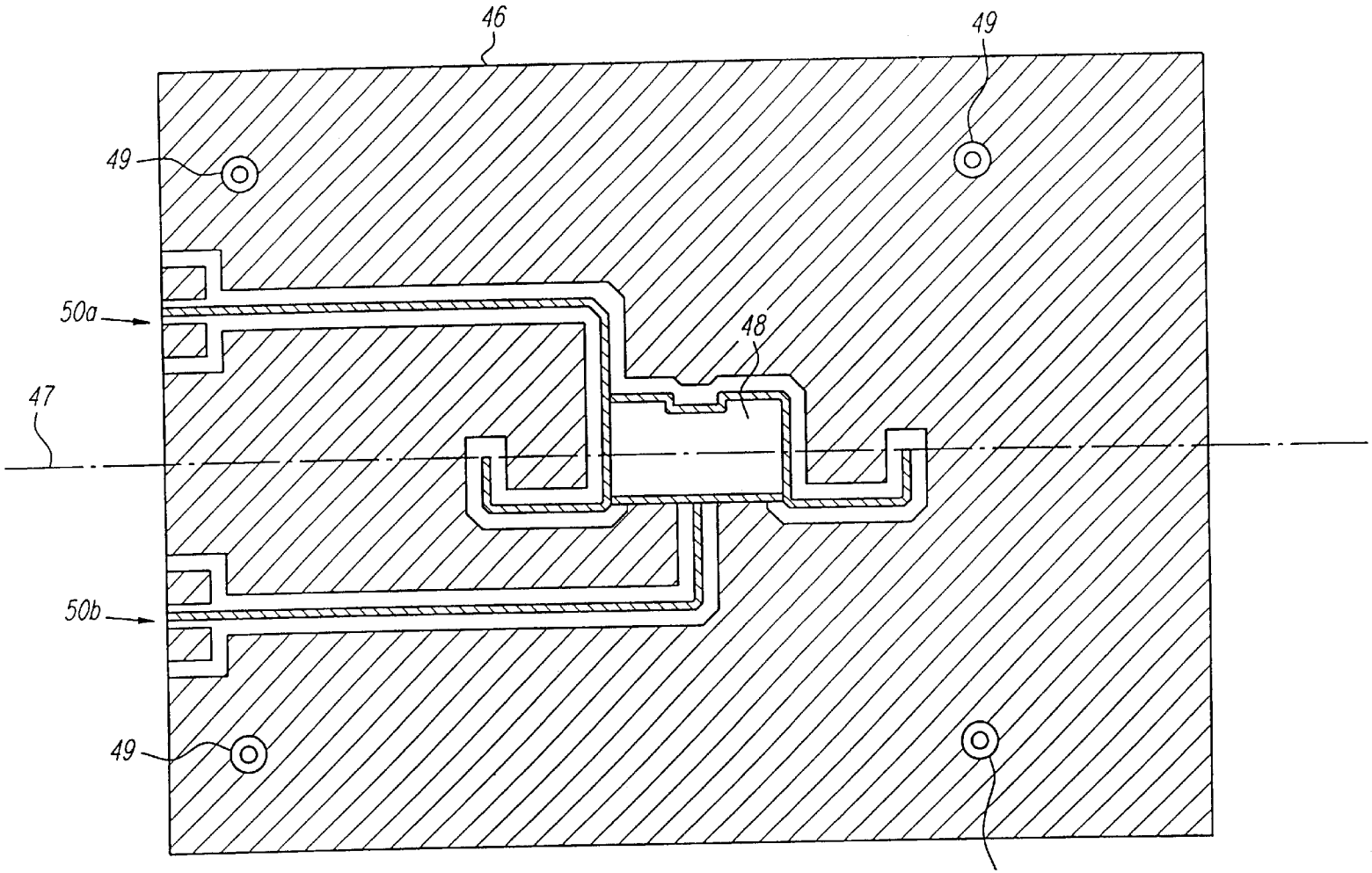
Figure 4C:
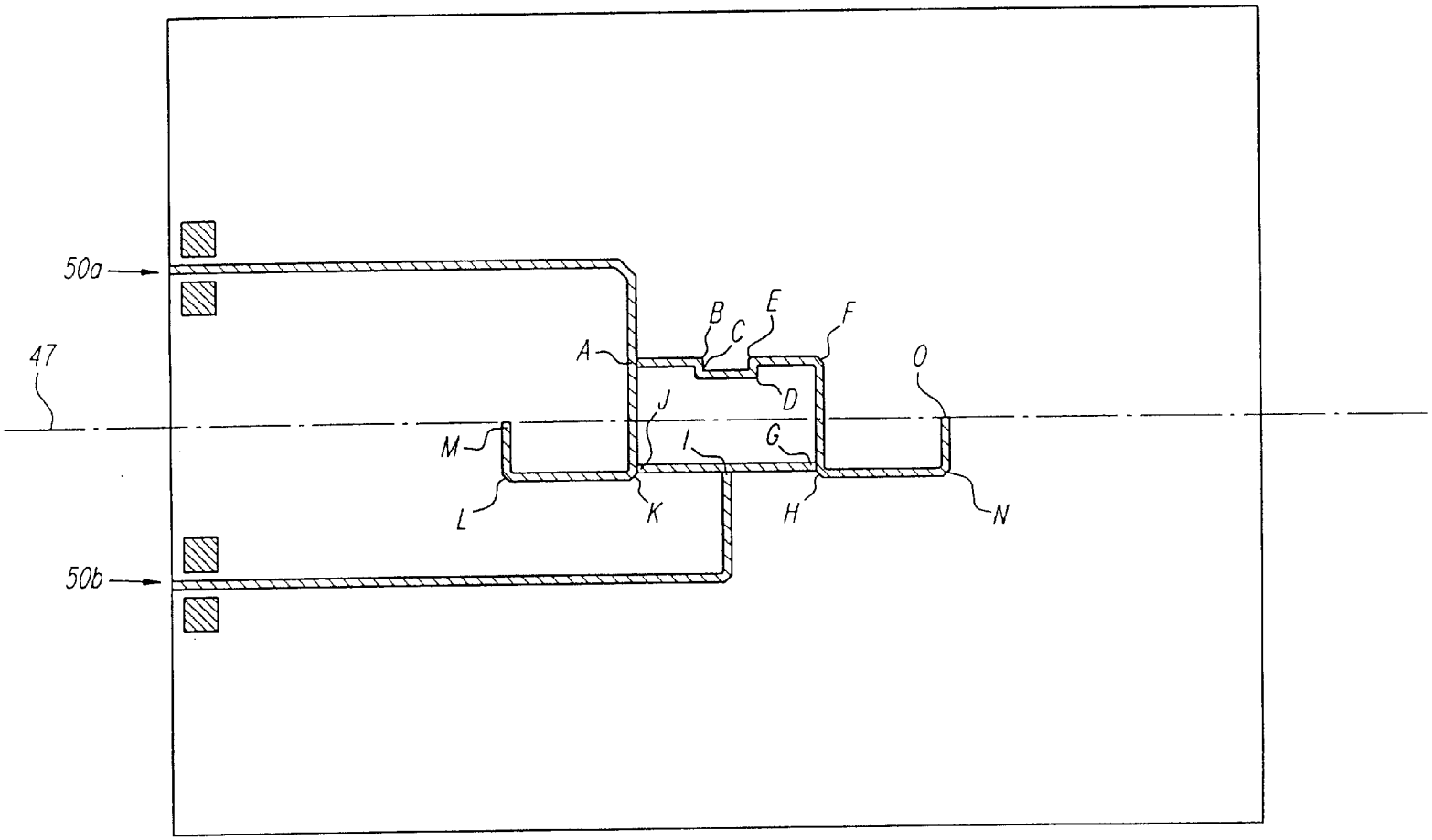
Figure 4D:
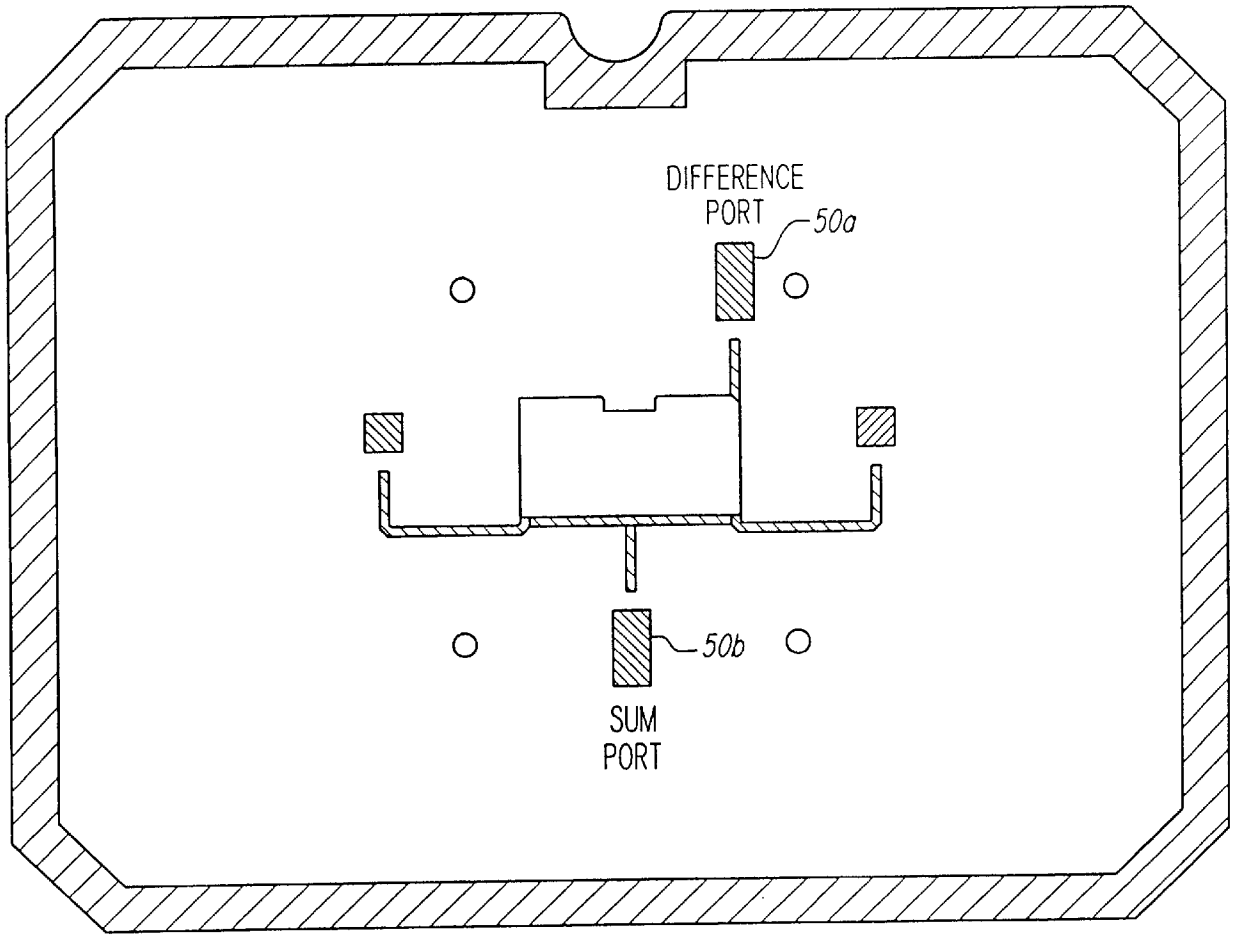
Figure 4E:
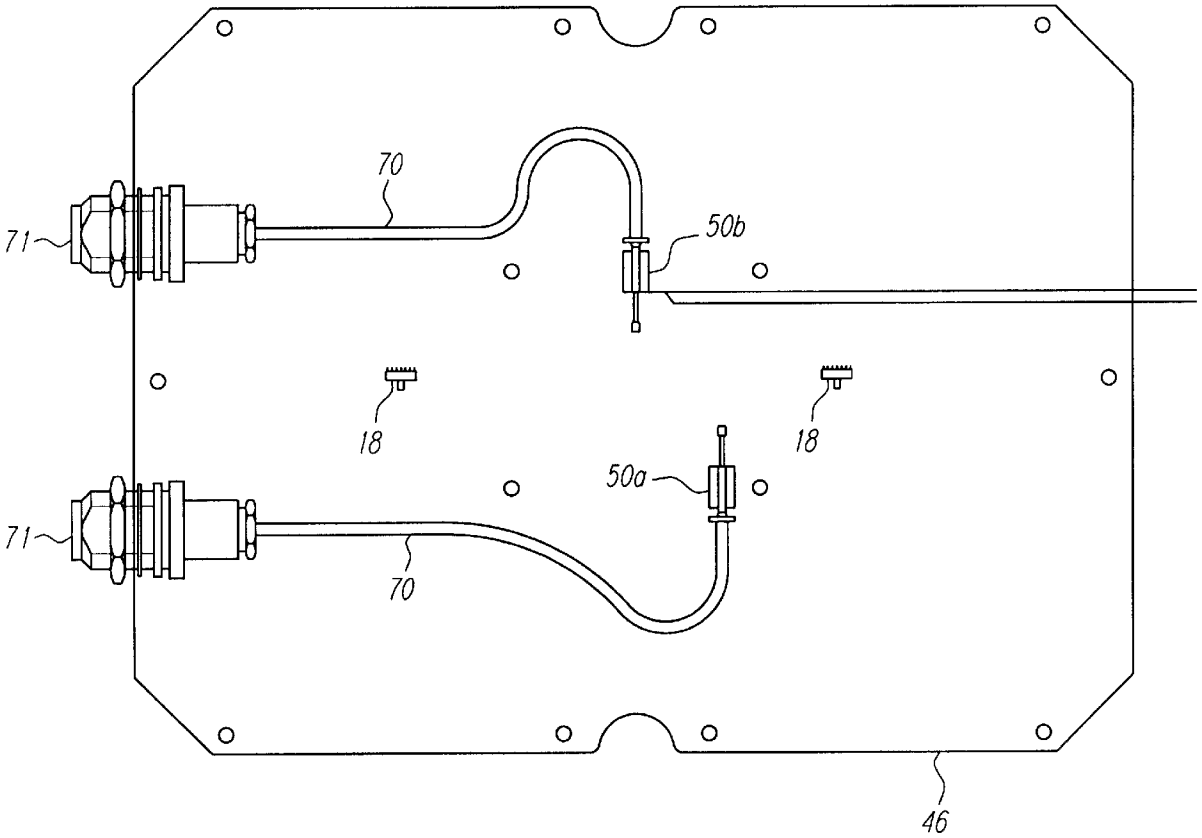
Figure 4F:
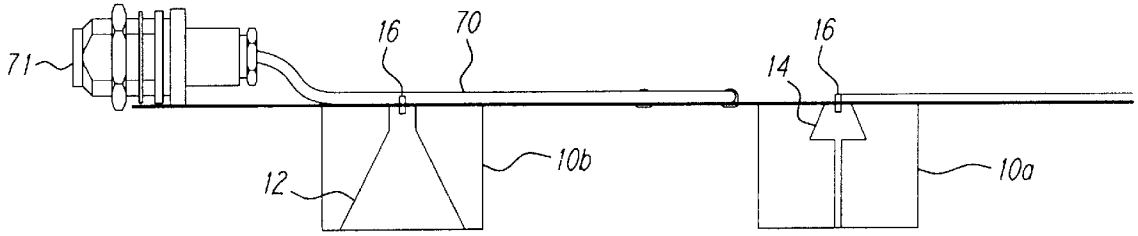
Figure 4G:
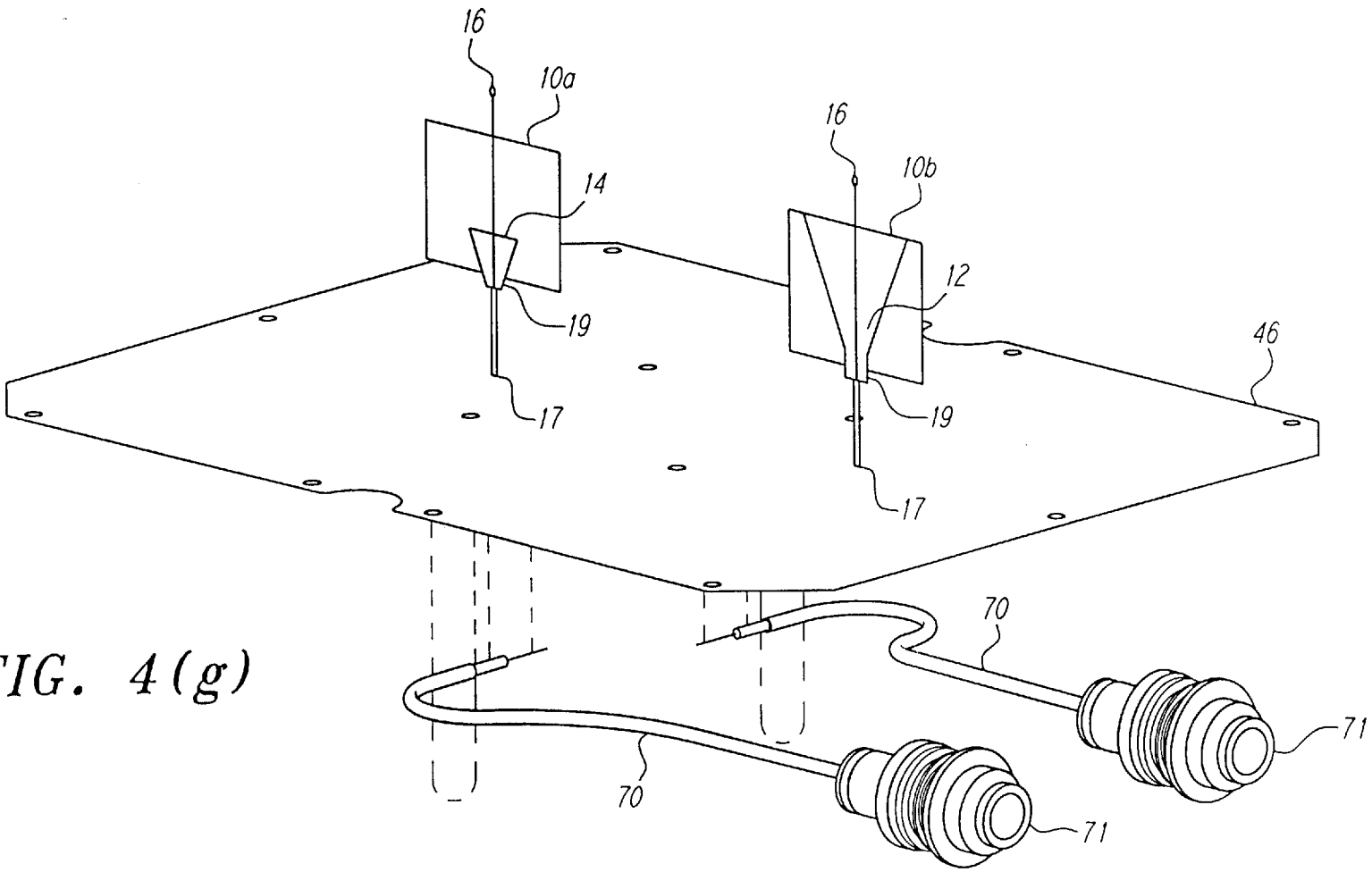
Figure 4H:
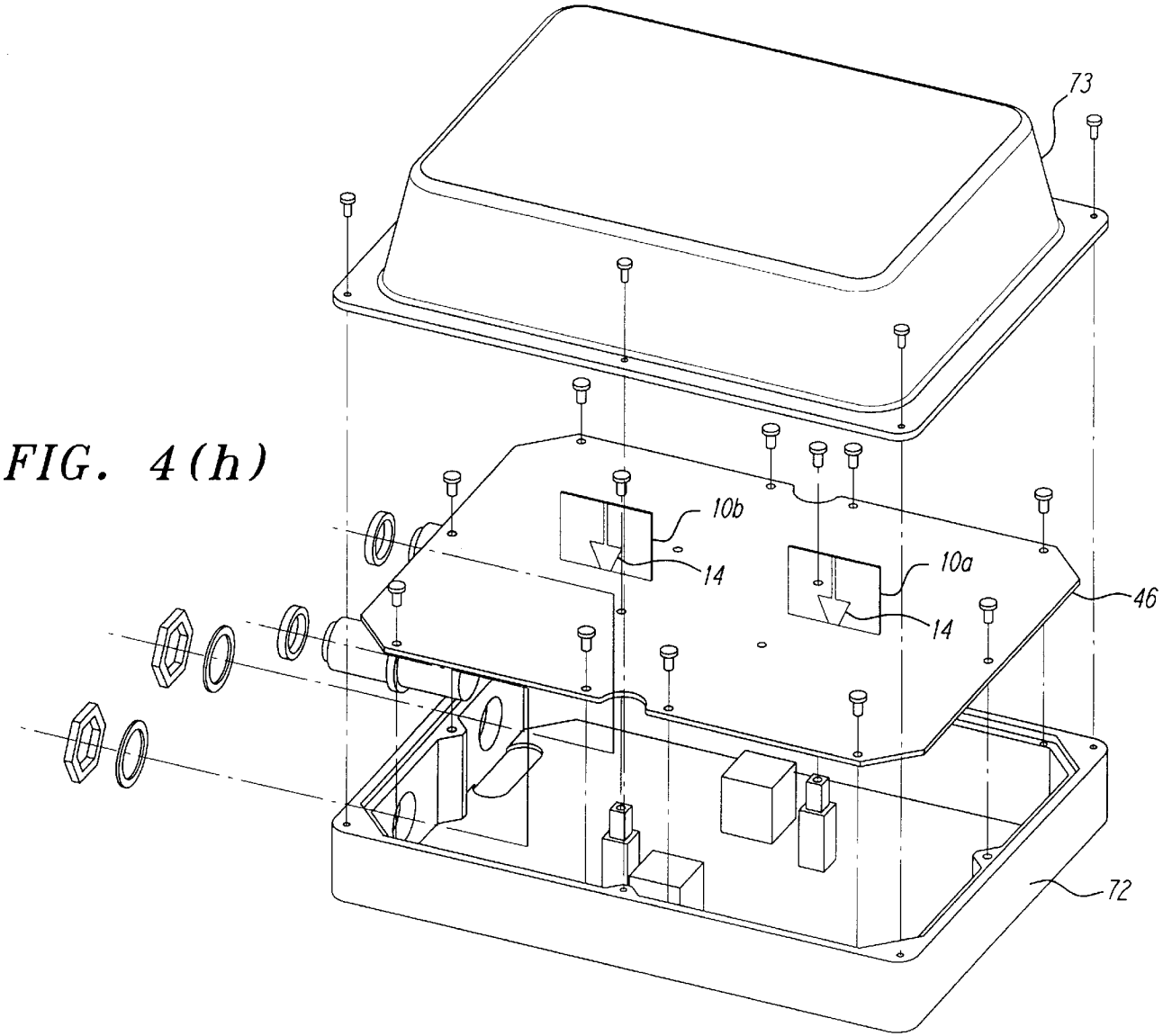

As shown in FIGS. 4*g* and 4*g,* it is preferred that the antenna elements 10*a* and 10*b* are arranged such that they face in opposite directions. Further, additional wave directors can be added to the ground plane to enhance performance in certain locations. Also as shown in FIG. 4*g* the dielectric 15 on which the parasitic element 14 and the radiating element 12 are mounted includes a tab 19. The ground plane includes a corresponding slot 17 into which the tab 19 is inserted. The parasitic element 14 covers the tab 19 and as a result when the tab 19 is inserted in the slot 17 the parasitic element is available to the side opposite the side on which the antenna element is mounted. This facilitates the grounding of the parasitic element and also provides additional structural support. The pin 16 extends through the hole 18 and is preferably soldered to parasitic element.

As shown in FIG. 4(*h*) the antenna array 44 is preferably mounted in a frame 72 and protected by a cover 73. The frame can be used as a ground and as the method for installing on traffic light poles 75 (FIG. 6) and other existing structures such as street light poles.

Figure 5A:
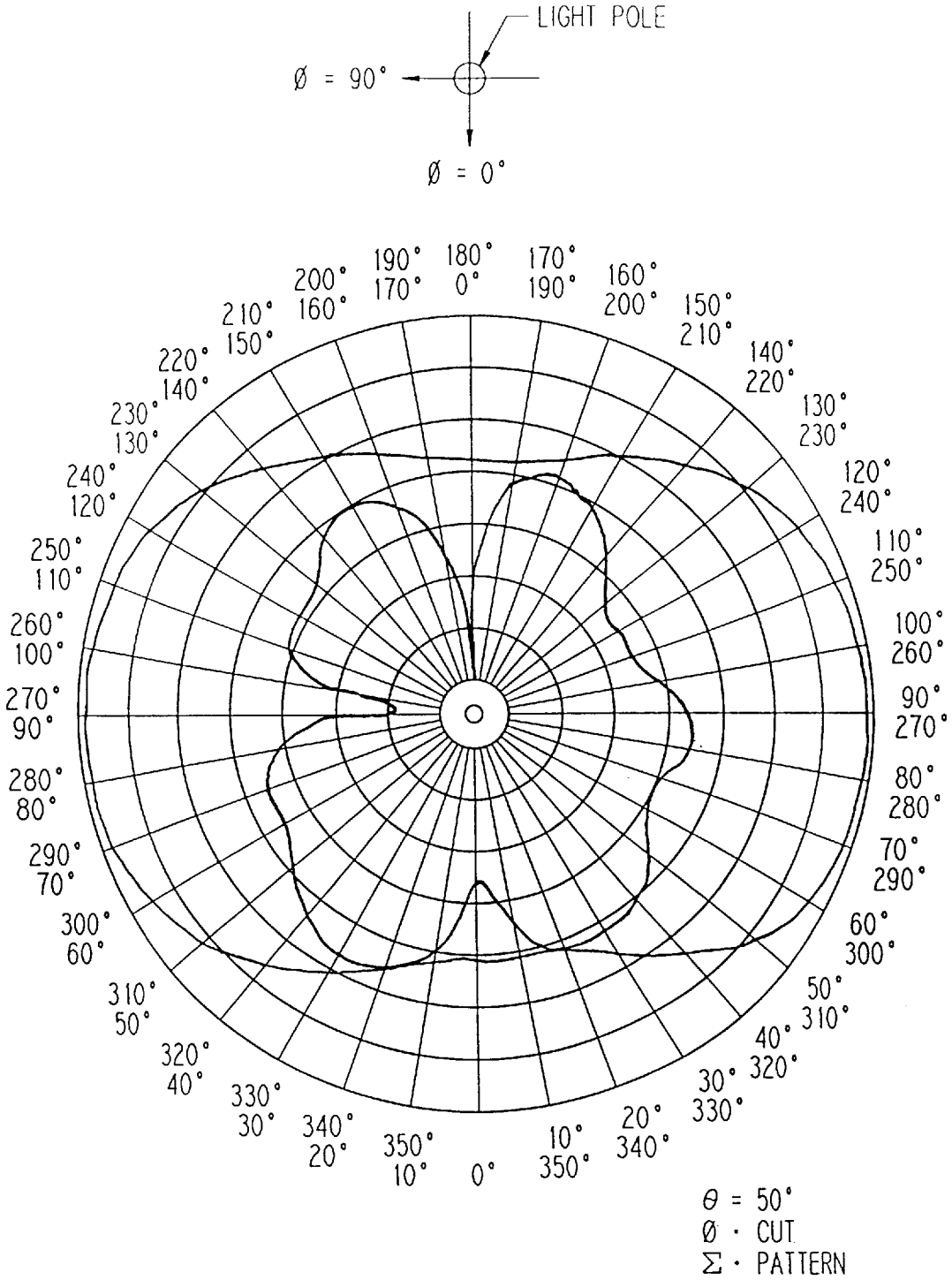
FIGS. 5(*a*) and 5(*b*) illustrate radiation patterns in the horizontal and elevation planes, respectively, at a summing port of a dual pattern diversity folded mono-bow antenna array in accordance with one form of the present invention.
Figure 5B:
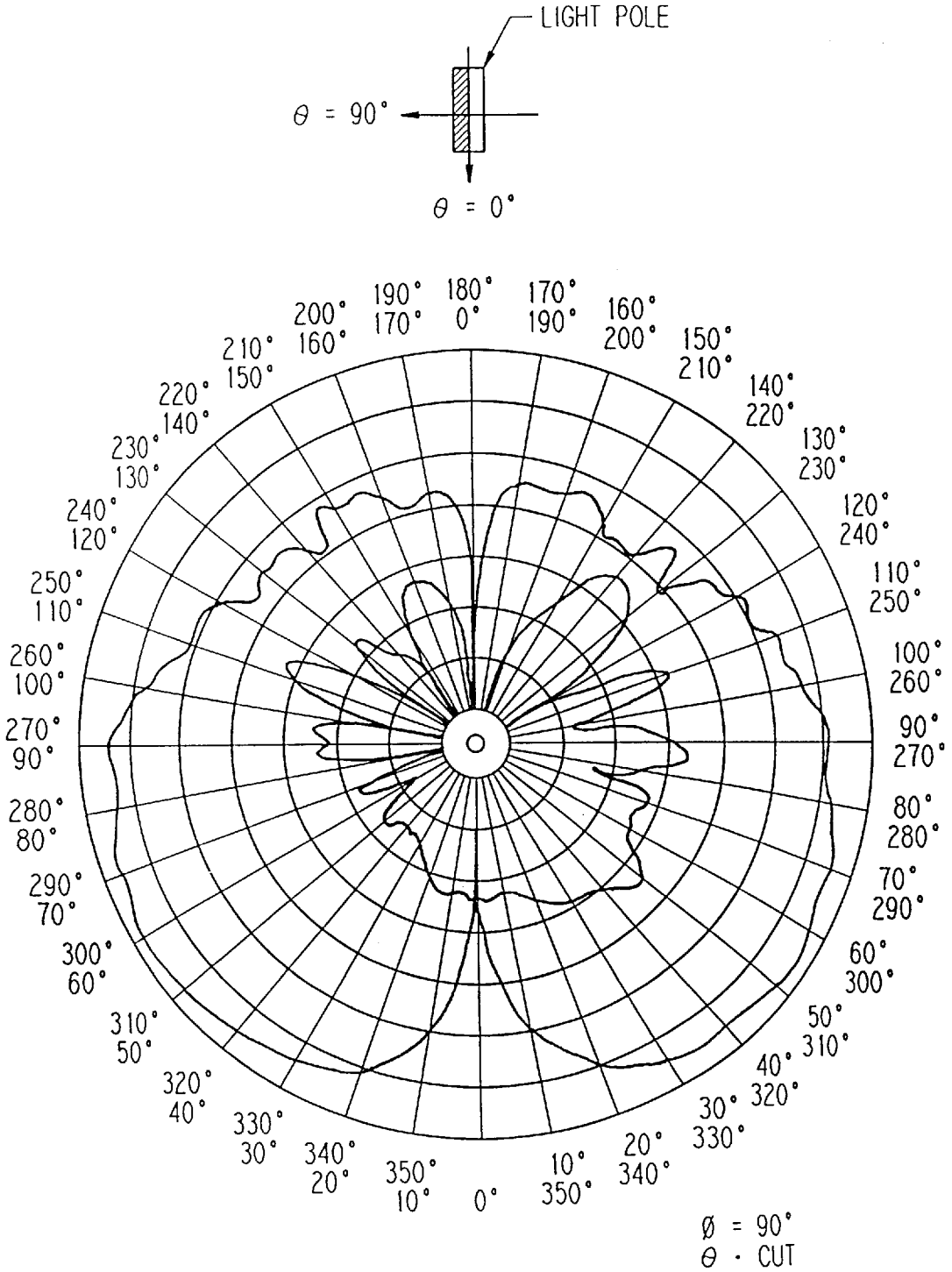

Exemplary radiation patterns for the summing port 50*b* of the dual pattern diversity folded mono-bow antenna array 44 described above are shown in FIGS. 5(*a*) and 5(*b*). As shown in FIG. 5(*a*), the in phase summation of the energy from the two antenna elements 10*a* and 10*b* at the hybrid summing port 50*b* results in a reduced azimuth beam width, dual direction radiation pattern with peaks at $\phi=90°$ and 270°, and nulls at $\phi=+/-90°$. Stated somewhat differently, the horizontal radiation pattern for the summing port 50*b* shows maximum gain in directions orthogonal to the central axis 47 of the antenna array 44 and reduced gain along the central axis 47 of the antenna array 44. In addition, as shown in FIG. 5(*b*), the elevation radiation pattern for the summing port 50*b* shows peak gains at $\Theta=50°$ and 310°.

Though not shown, the horizontal radiation pattern for the difference port 50*a* of the dual pattern diversity folded mono-bow antenna array 44 is effectively the complement of the radiation pattern for the summing port 50*b*. Moreover, the out-of-phase summation of the energy from the two antenna elements 10*a* and 10*b* at the hybrid difference port 50*a* results in a reduced azimuth beam width, dual direction radiation pattern with peaks at $\phi=0°$ and 180°.

Figure 6:
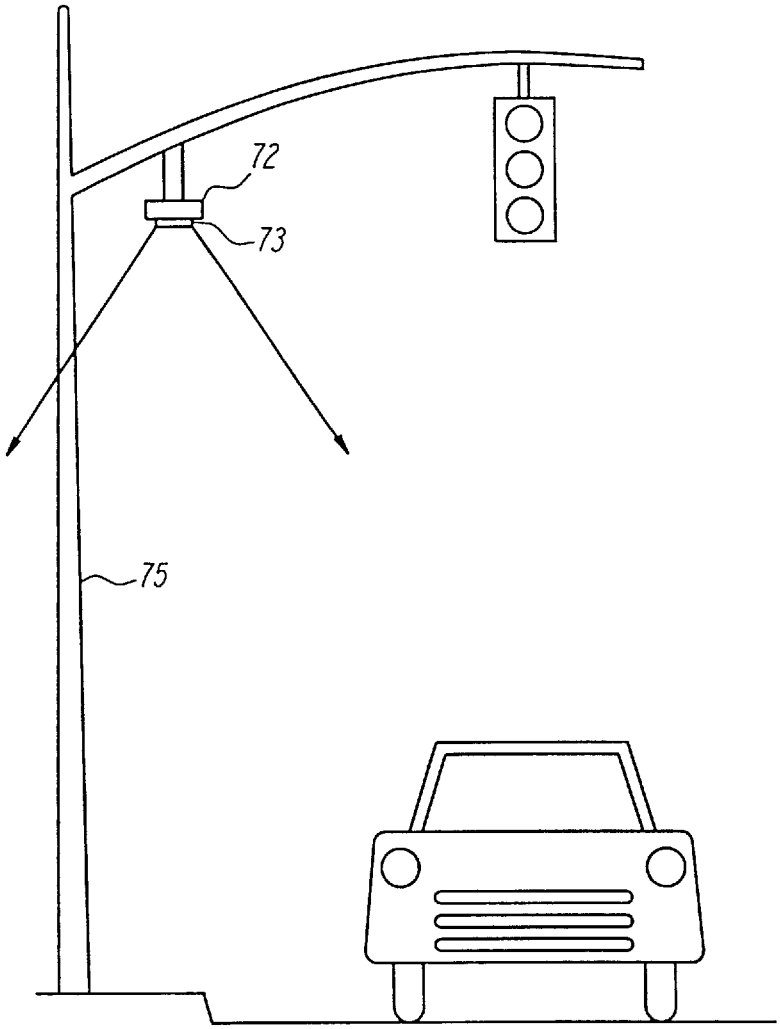
FIG. 6 illustrates a preferred deployment of a dual pattern diversity folded mono-bow antenna in accordance with the present invention.

Given the above described properties of the radiation patterns of a dual pattern diversity folded mono-bow antenna array 44 in accordance with the present invention, it is clear that such an array is well suited for mounting on light poles (or other similar structures) within a dense urban environment. The reason for this is that the nulls in the horizontal radiation pattern of, for example, the summing port 50*b* of the antenna array 44 may be directed to the light pole on which the antenna array 44 is mounted, thus, minimizing multipath (i.e., beam reflections) emanating from the light pole. This multipath rejection capability effectively eliminates a need to mount the antenna array 44 at any substantial distance from an associated light pole (or other supporting structure) and, therefore, provides for very compact installation within an urban (or other) environment. Further, if the antenna elements 10*a* and 10*b* are arranged in a downward facing direction (i.e., extend from the ground plane 46 in the direction of the street in an urban environment), channeling within an urban canyon is minimized. The reason for this is that the antenna array 44, when deployed in a downward facing direction, directs the majority of its energy toward the user level on the street, has reduced gain at the horizon and provides a null region close to the installation to reduce interference from portable units directly beneath the installation. This is shown in FIG. 6.

Four Beam Monopole Diversity Antenna Arrays

Figure 7A:
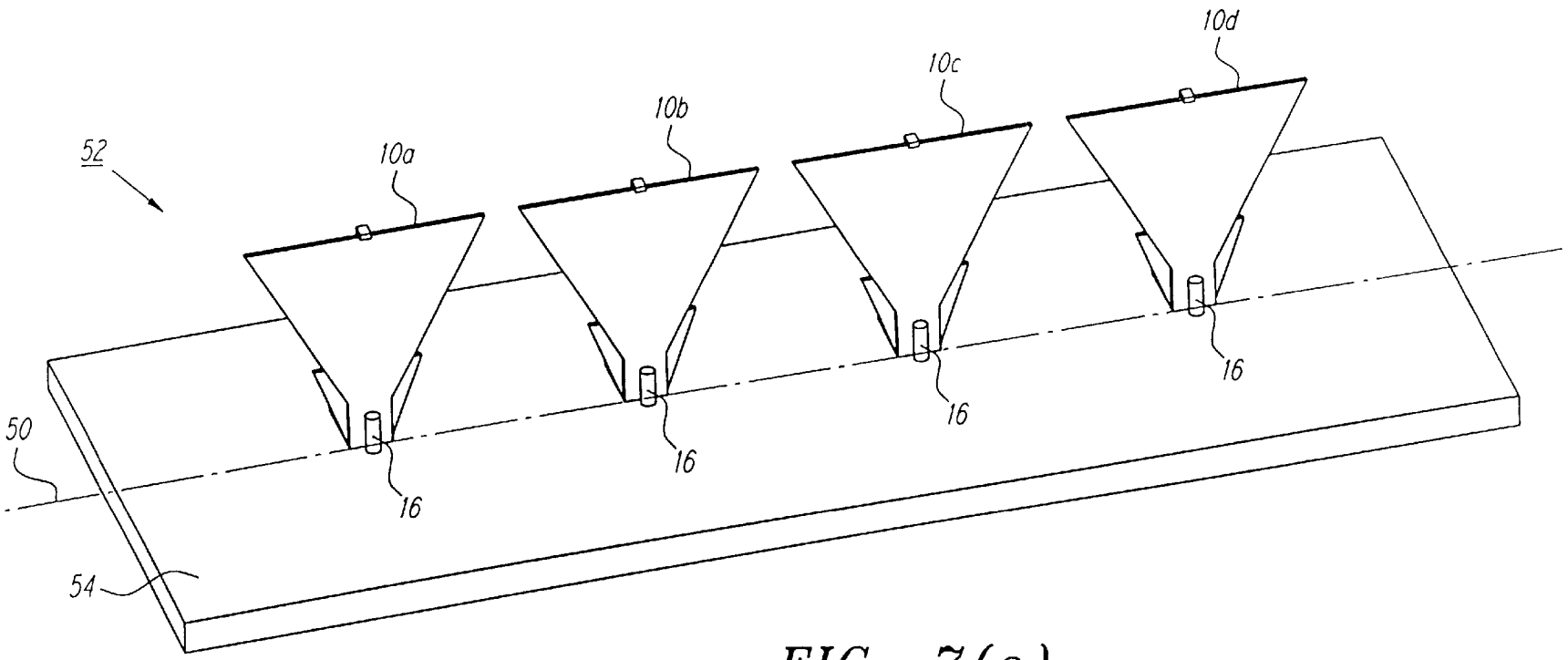
FIG. 7(*a*) illustrates a preferred 4-beam monopole diversity antenna array in accordance with the present invention.
Figure 7B:
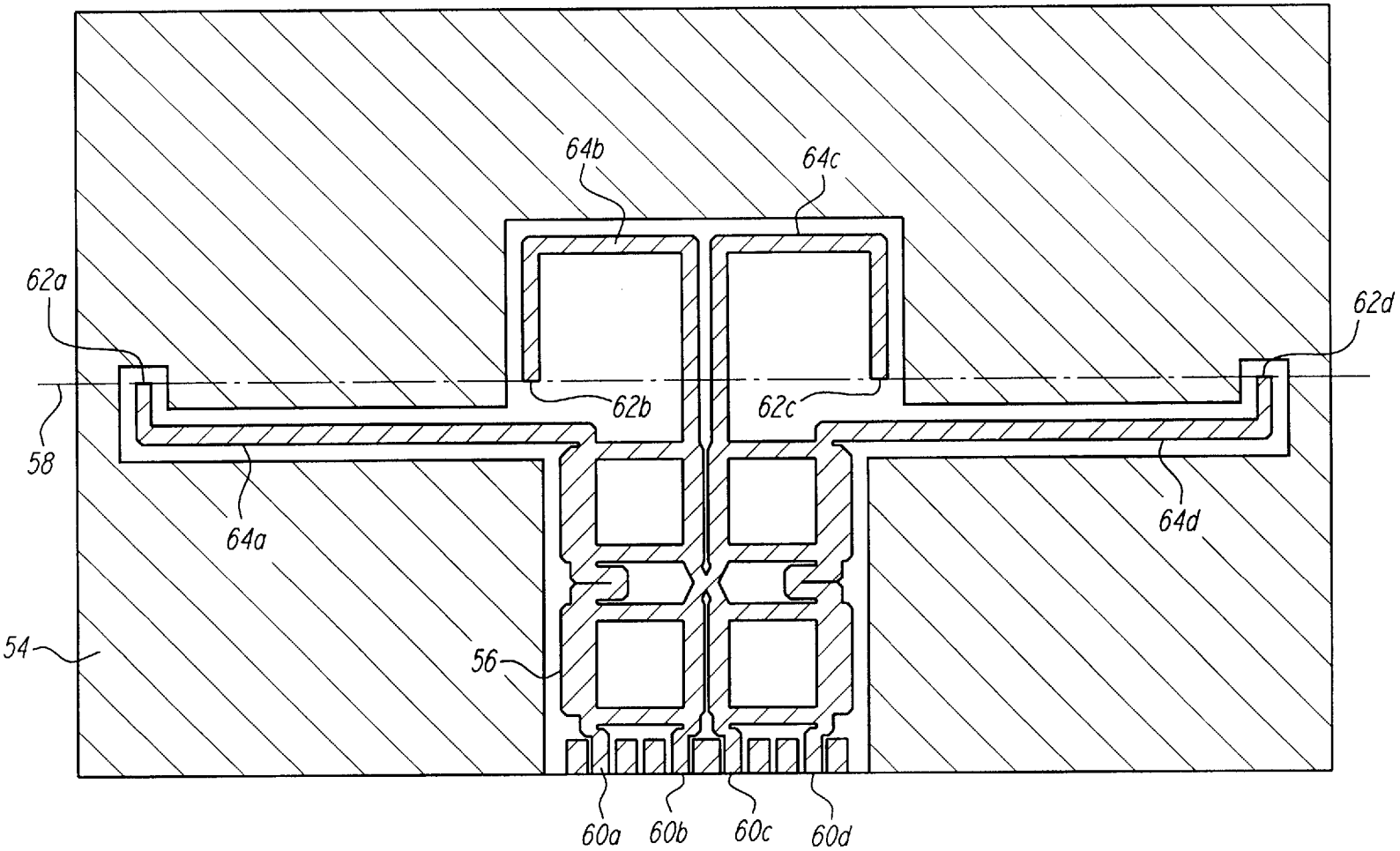
Figure 7C:
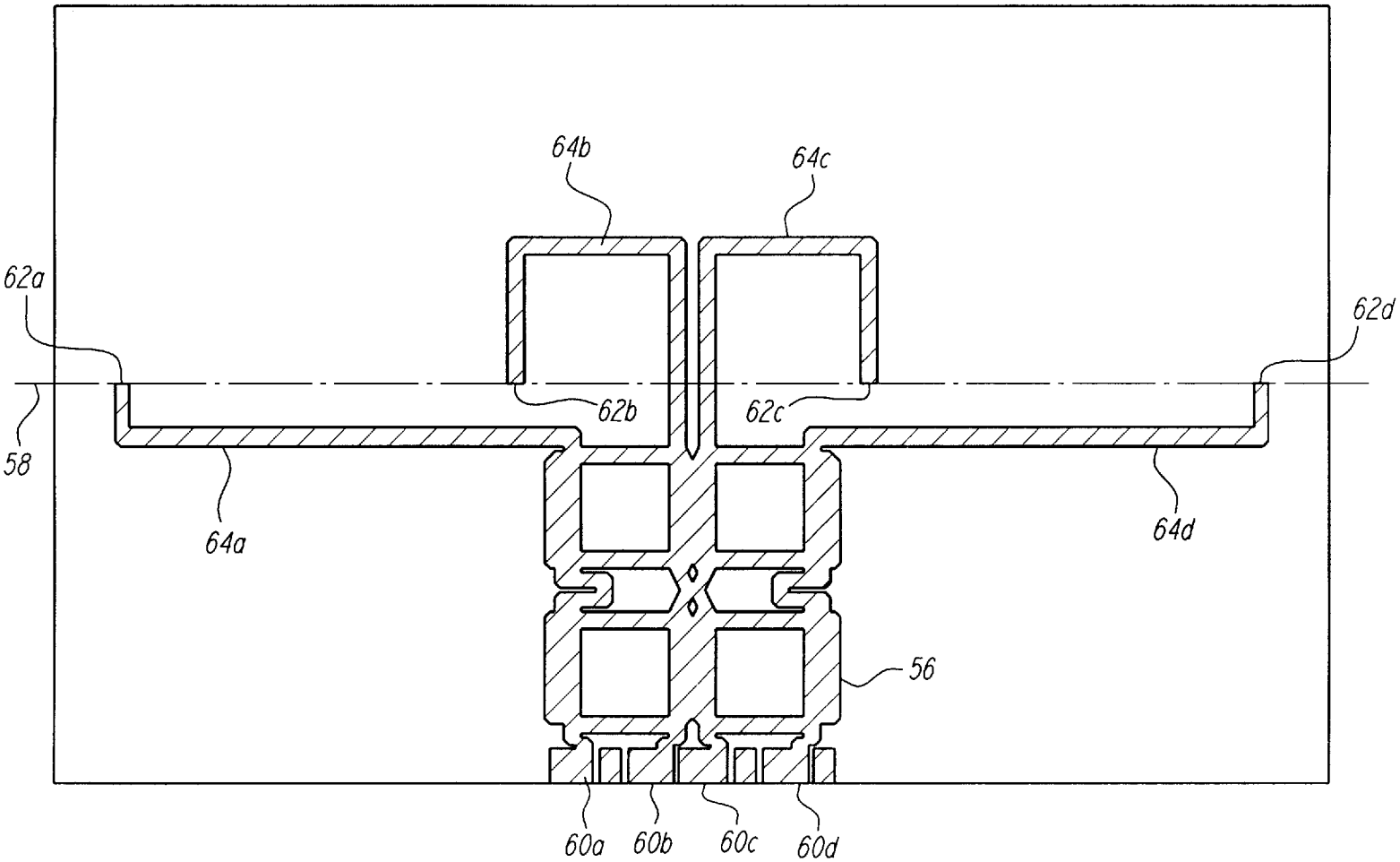

In another innovative aspect, the present invention is directed to the implementation, manufacture and use of four beam monopole diversity antenna arrays. Moreover, as shown in FIGS. 7(*a*) and 7(*b*), a four beam monopole diversity antenna array 52 in accordance with the present invention preferably comprises four folded mono-bow antenna elements 10*a*–10*d,* such as those described above, a common ground plane 54 and a butler matrix combiner/splitter circuit 56. In a preferred form, the common ground plane 54 comprises a printed circuit board substrate having opposing coplanar surfaces (i.e. a top surface and a bottom surface) whereon respective layers of copper cladding are deposited. The butler matrix combiner/splitter circuit 56, shown in FIG. 7(*b*), are preferably formed by etching away portions of the copper cladding deposited on one of the surfaces of the printed circuit board substrate. As explained above, the copper cladding layer deposited upon the top surface of the printed circuit board substrate and portions of the copper cladding layer deposited on the bottom surface of the printed circuit board substrate are preferably electrically connected by a series of plated through-holes (not shown) formed in the printed circuit board substrate. A standard type N coax connector is provided at each of the input ports 60*a*–60*d* of the butler matrix combiner/splitter circuit 56, and the tips 62*a*–62*d* of the antenna feed lines 64*a*–64*d* are connected to respective feed pins (not shown) which extend through insulated holes (not shown) formed in the common ground plane 54 and are coupled to the mono-bow antenna elements 10*a*–10*d*. Presently preferred dimensions of the metal traces comprising the butler matrix combiner/splitter circuit 56 areas follows: Lines 64*a* and 64*d* are preferably spaced 600 mils from the centerline 58. Preferably the center to center spacing between lines 62*a* and 62*b,* between lines 62*b* and 62*c* and between 62*c* and 62*d* is 3.1 inches. Preferably lines 64*b* and 64*c* are 1362.5 mils. Preferably the traces are 59 mils wide and preferably the ground plane id 7" by 14.3".

As shown in FIG. 7(*a*), the folded mono-bow antenna elements 10*a*–10*d* may be mounted along a central axis 58 of the common ground plane 56 and should be separated by a distance substantially equal to ½ of the wavelength of the radio frequency waves to be transmitted and received by the antenna array 52. As it is presently preferred that the folded mono-bow antenna elements 10*a*–10*d* provide for optimal transmission and reception at a frequency of 1920 MHZ, adjacent folded mono-bow antenna elements are, preferably, separated by a distance of substantially 3.3 inches. It is also presently preferred that the common ground plane 54 be substantially rectangular in shape, have a width of substantially 7.0 inches and have a length of substantially 14.3 inches. However, it should be appreciated that by varying the dimensions of the common ground plane 54 it is possible to vary the radiation pattern of the antenna array 52 to address the system design goals of a given installation site. Moreover, depending upon the design goals of a given installation, it may be desirable to the dimensions of the ground plane 54, the dimensions of the folded mono-bow antenna elements 10*a*–10*d* may be modified in accordance with the teachings presented here or, perhaps, in some circumstances to substitute some other type of antenna (for example, another type of monopole antenna) for the antenna elements 10*a*–10*d* described above.

Figure 8:
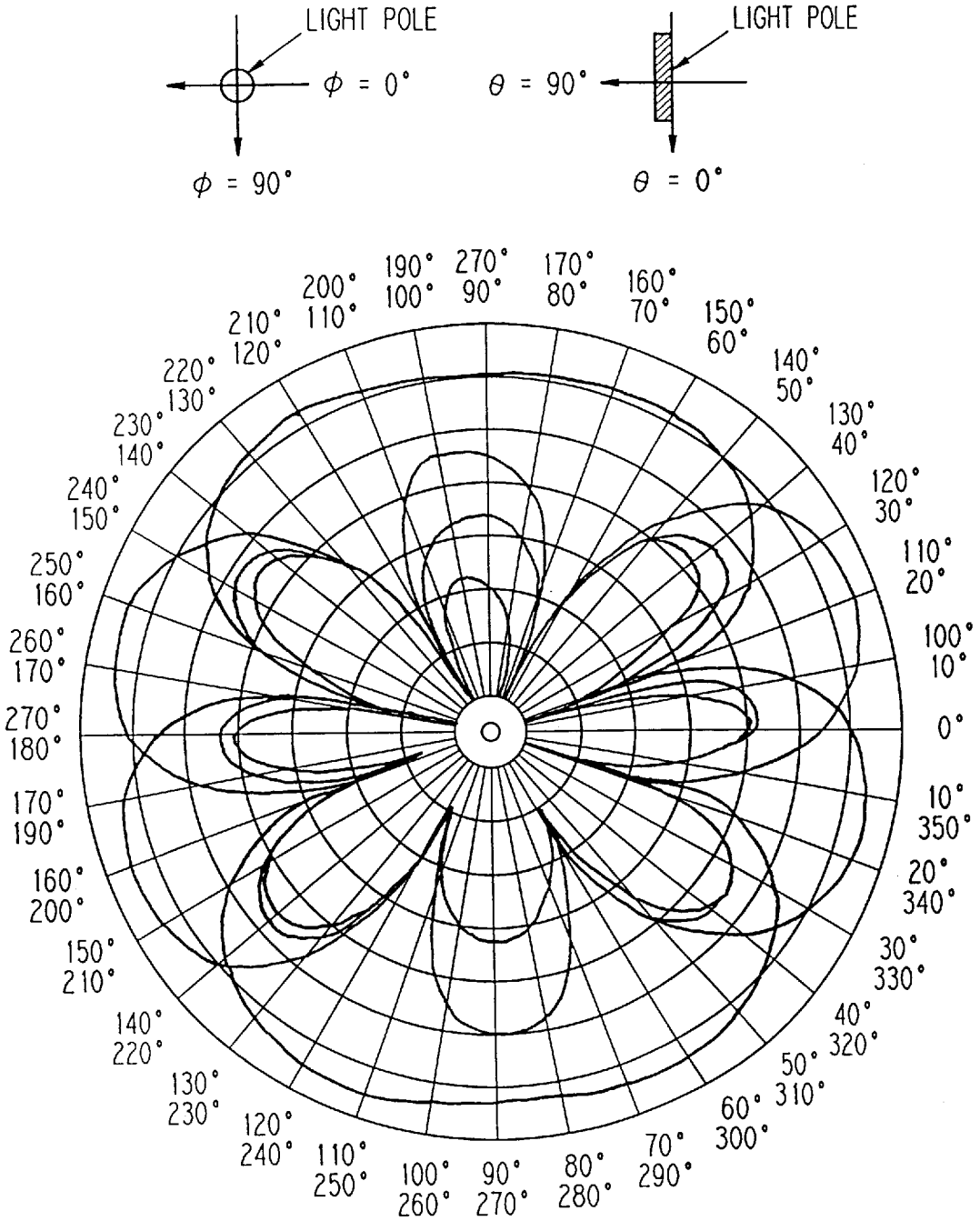
FIG. 8 provides an exemplary illustration of the radiation pattern of the energy at the summing ports of the butler matrix utilized in accordance with the 4-beam monopole diversity antenna array shown in FIGS. 7(*a*)–7(*c*).

Turning now to FIG. 8, the summation of the energy from the four folded mono-bow antenna elements 10*a*–10*d* at each of the butler matrix input ports 60*a*–60*d* results in a narrow azimuth beam width, dual directional radiation pattern with peaks at approximately $\phi$=13.5°, 40.5°, 116.5°, 193.5°, 220.5° and 319.5° in the horizontal plane. Thus, it will be appreciated that, using a four beam monopole diversity antenna array 52 in accordance with the present invention, it is possible to achieve a bidirectional pattern in the horizontal plane, while simultaneously providing multipattern diversity. This makes a four beam monopole diversity antenna array 52, such as that described above, well suited for use within communications systems which use pattern diversity to achieve multipath mitigation. Because the gain in the elevation plane of the antenna elements 10*a*–10*d* comprising the antenna array 52 may be varied depending upon the dimensions of the common ground plane 54, the antenna array 52 may also be used to combat channeling in an urban canyon.

Dual Polarized 4-Way Diversity Antenna Arrays

Figure 9:
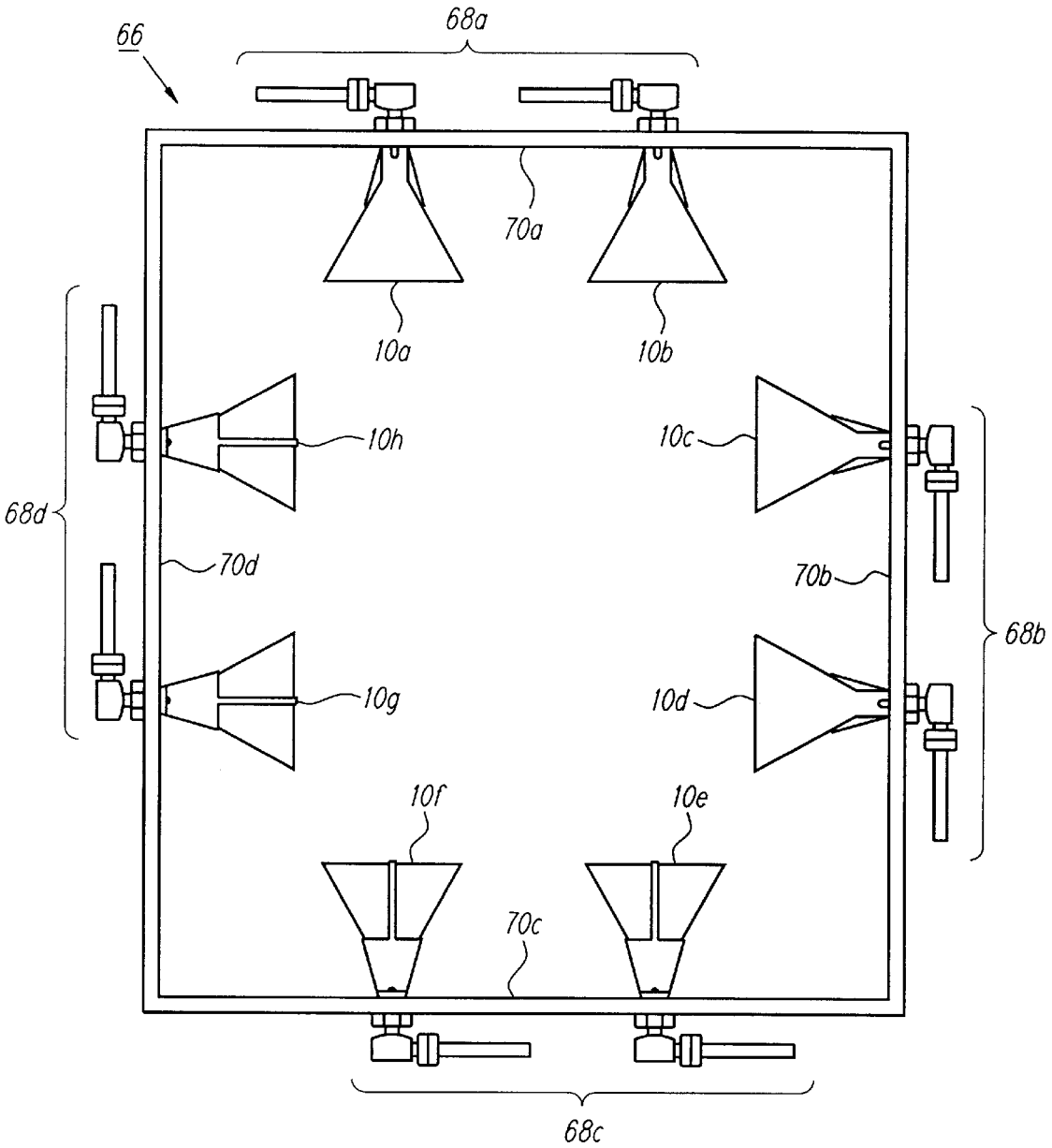
FIG. 9 is an illustration of a preferred dual polarized 4-way diversity antenna array in accordance with the present invention.

In still another innovative aspect, the present invention is directed to the implementation, manufacture and use of dual polarized 4-way diversity antenna arrays. As shown in FIG. 9, a dual polarized 4-way diversity antenna array 66 in accordance with the present invention preferably comprises four antenna modules 68*a*–68*d* wherein each of the antenna modules comprises a dual pattern diversity folded mono-bow antenna array (such as the array 44 described above), and wherein the four antenna modules 68*a*–68*d* generally form a parallel piped structure with respective pairs of the antenna modules 68*a*–68*d* being arranged in an opposing and parallel orientation. While the antennas 10*a*–10*h* comprising the dual polarized 4-way diversity antenna array 66 shown in FIG. 9 are shown as being fed by conventional coax connectors which, in turn, may be coupled to a set of 0° combiner/splitter circuits, "Tee" splitters or Wilkinson™ power dividers (not shown), a plurality of 0° combiner/splitter circuits are preferably formed on the copper clad printed circuit board substrates which comprise the ground planes 70*a*–70*d* of the antenna modules 68*a*–68*d*.

By providing two antenna modules (i.e., antenna modules 68*a* and 68*c* or antenna modules 68*b* and 68*d*) in each polarization and by separating those modules by a distance of substantially one wavelength (6.6 inches in one preferred embodiment), it is possible to achieve a high degree of separation diversity within a dense urban environment. Further, since the effectiveness of various diversity schemes is multiplicative, the combination of separation diversity and polarization diversity provided by the dual polarized 4-way diversity antenna array 66 may provide a very powerful multipath mitigation tool.

As explained above, depending upon the design goals of a given installation according to the teachings presented herein, the dimensions of the ground planes 70*a*–70*d* (either collectively or independently may be modified; the dimensions of the folded mono-bow antenna elements 10*a*–10*h* used within the antenna modules 68*a*–68*d* may be modified; and in some circumstances some other type of antenna (for example, another type of monopole antenna) for the antenna elements 10*a*–10*h* described above may be utilized. Nonetheless, in one preferred form, the respective antenna modules 68*a*–68*d* include similar elements to those illustrated in FIGS. 4(*a*)–4(*c*) described above and, thus, each provide radiation at a respective summing port (not shown) which is substantially the same as that shown in FIGS. 5(*a*) and 5(*b*); when the ground planes 70*a*–70*d* of the respective antenna modules 68*a*–68*d* have substantially the same dimensions as the ground plane shown in FIGS. 4(*a*)–(*c*).

Omnidirectional Dual Pattern Diversity Antenna Arrays

Figure 10:
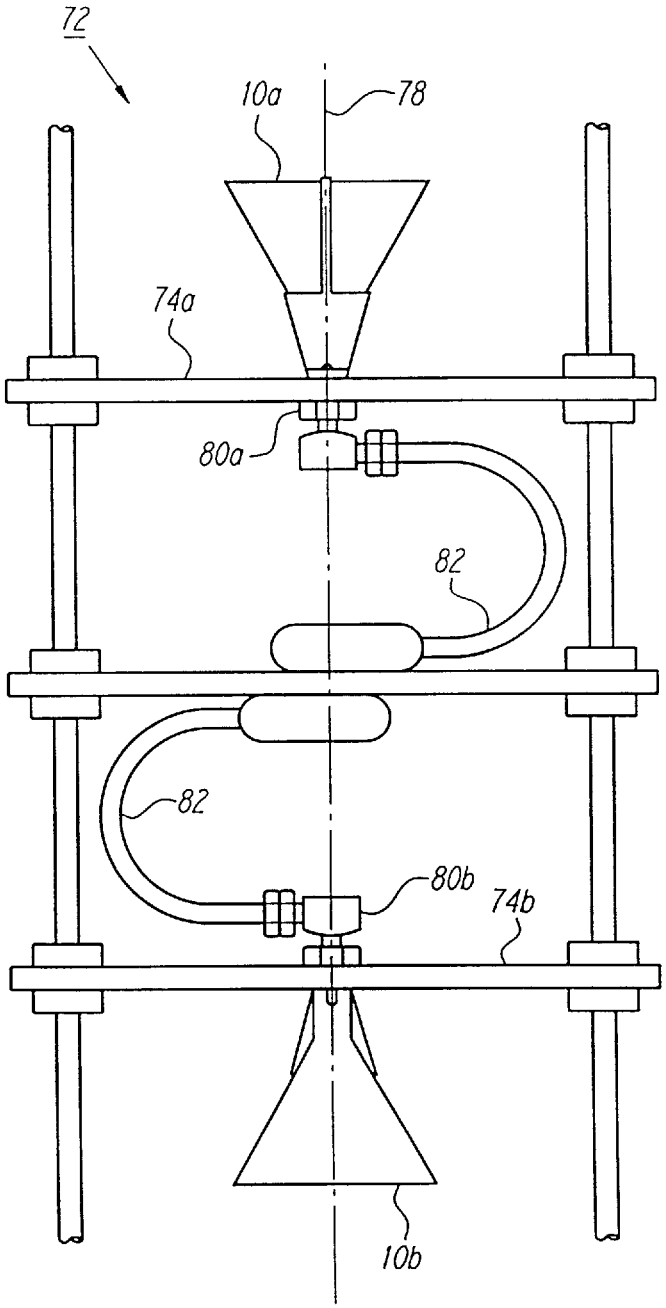
FIG. 10 is an illustration of a preferred omnidirectional dual pattern diversity antenna array in accordance with the present invention.

In still another innovative aspect, the present invention is directed to the implementation, manufacture and use of omnidirectional dual pattern diversity antenna arrays. Moreover, as shown in FIG. 10, an omnidirectional dual pattern diversity antenna array 72 in accordance with the present invention preferably comprises two folded mono-bow antenna elements 10*a* and 10*b* which are mounted to respective ground planes 74*a* and 74*b* and connected to a 180° hybrid combiner network (not shown). The folded mono-bow antenna elements 10*a* and 10*b* are preferably oriented along a common vertical axis 78, are preferably separated by one half of a selected wavelength (i.e., separated by substantially 3.3 inches in one preferred form), and are oriented in contra-direction with respect to one another.

In one preferred form, the ground planes 74*a* and 74*b* has a substantially square shape and measures substantially 4.0 inches on a side. Further, if SMA connectors 80*a* and 80*b* are used to provide an interface to the folded mono-bow antenna elements 10*a* and 10*b*, a relatively short, phase matched length of coaxial cable 82 is preferably used to connect each of the antenna elements 10*a* and 10*b* to the output ports (not shown) of the 180° hybrid combiner network (not shown). In contrast, if the antenna interfaces are provided by feed pins (not shown) soldered to the element feed points (not shown) of a pair of microstrip transmission lines (not shown) formed on the printed circuit board substrates comprising the respective ground planes 74*a* and 74*b*, then a short length of coaxial cable may be soldered to the microstrip transmission lines (not shown) and to the output ports (not shown) of the 180° hybrid combiner network. The input ports (not shown) of the 180° hybrid combiner network may be terminated with suitable RF connectors (for example, type N coax connectors).

Figure 11A:
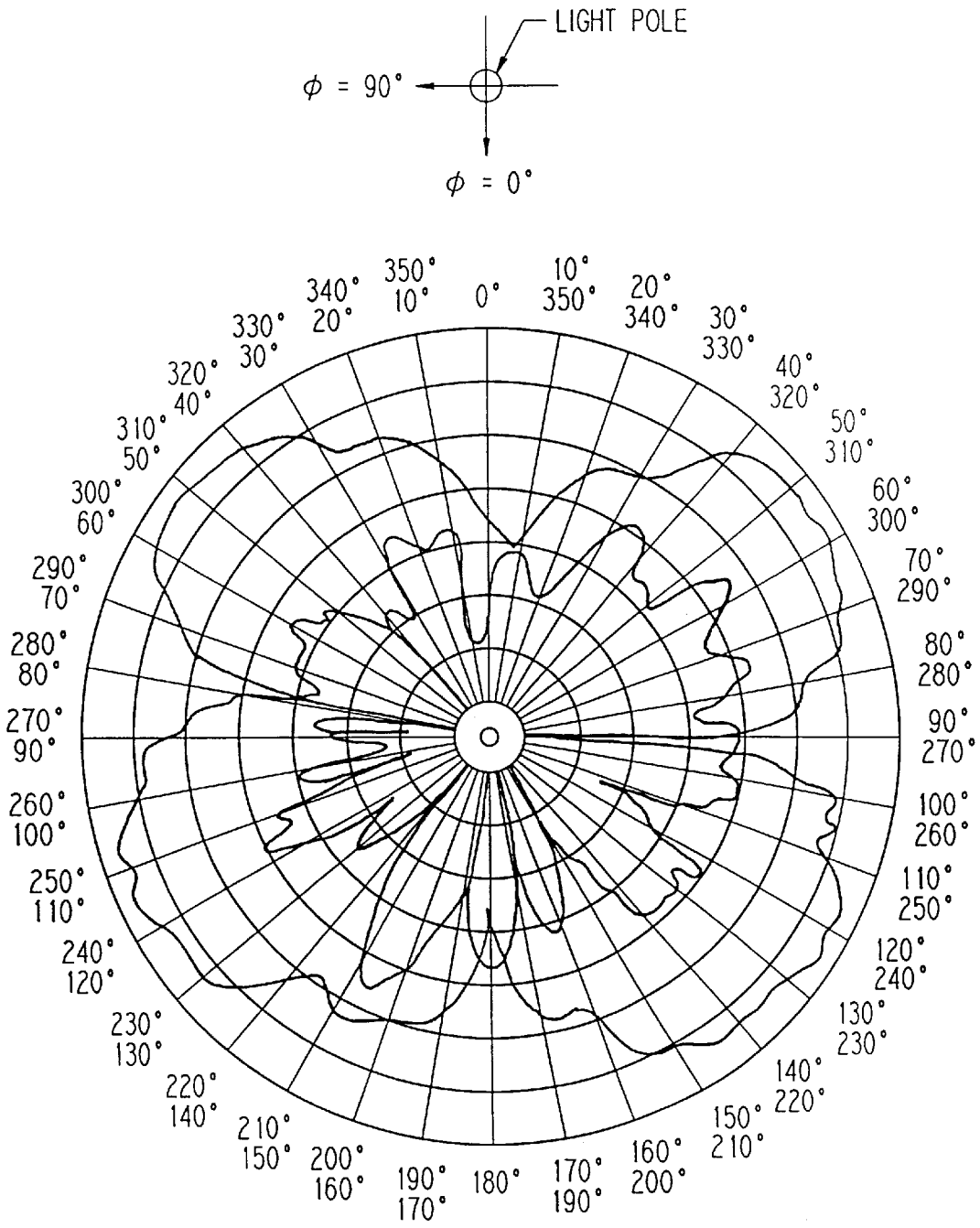
FIGS. 11(*a*) and 11(*b*) provide exemplary illustrations of the radiation patterns at the summation and difference ports, respectively, of the 180° hybrid combiner network depicted with the omnidirectional dual pattern diversity antenna array shown in FIG. 10.
Figure 11B:
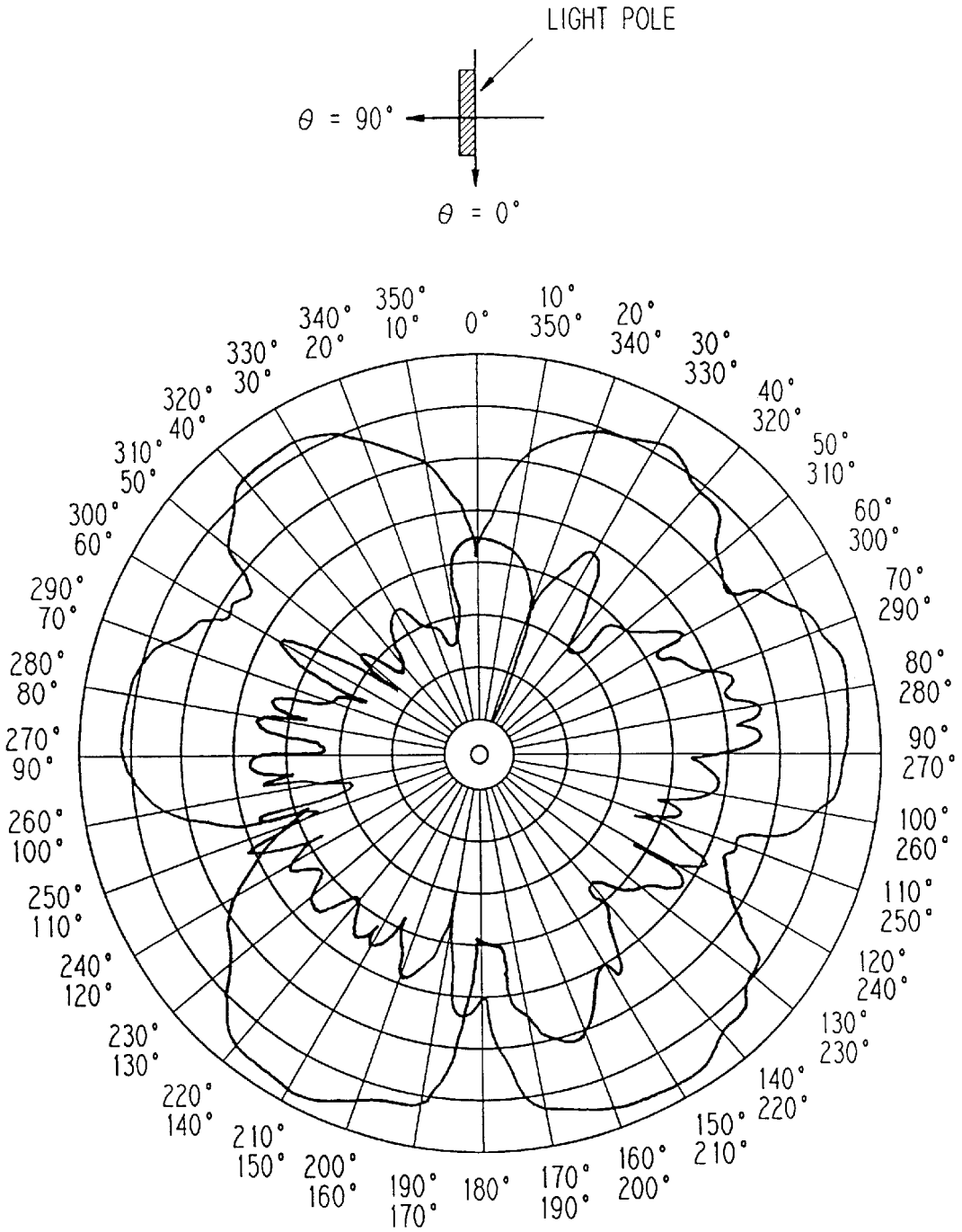

Turning now also to FIGS. 11(*a*) and 11(*b*), when the energy received by two contra-directional folded mono-bow antenna elements 10*a* and 10*b* is combined using the 180° hybrid combiner network, the radiation pattern of the array 72 takes on two substantially separate orthogonal shapes in the elevation plane. Moreover, the in-phase summation of the energy from the two folded mono-bow antenna elements 10*a* and 10*b* at the combiner (i.e., summation) port produces a radiation pattern having four main lobes at approximately $\Theta$=60°, 120°, 240° and 300° that are substantially omnidirectional in $\phi$ and null at $\Theta$=+/−90°. At the difference port, the energy sums to produce six main lobes at about $\Theta$=+/−30°, +/−90°, and +/−150° which also are substantially omnidirectional in $\phi$.

By using two omnidirectional dual pattern diversity antenna arrays, such as those described above, with greater than one wavelength spacing in the horizontal plane, it is possible to achieve a 4-way diversity scheme which employs both separation and pattern diversity methodologies. Again, because diversity schemes, or methodologies, are multiplicative in effect, the use of omnidirectional dual pattern diversity antenna arrays, such as those described and claimed herein, may provide a powerful tool for multipath mitigation and building penetration in a dense urban environment. However, it should be understood that the antenna elements and antenna arrays described and claimed herein are by no means limited to applications within dense urban environments.

While the invention of this application is susceptible to various modifications and alternative forms, specific examples thereof have been shown by way of example in the drawings and are herein described in detail. It is to be understood, however, that the invention is not to be limited to the particular forms or methods disclosed, but to the contrary, the invention is to broadly cover all modifications, equivalents, and alternatives encompassed by the spirit and scope of the appended claims.

What is claimed is:

1. A folded mono-bow antenna for use in cellular and other wireless communications systems, comprising:

a ground plane having a hole formed therein;

a feed pin extending through said hole formed in said ground plane;

a radiating element coupled to said feed pin, said radiating element comprising a first thin metal sheet and including a main radiating section and a pin coupling section, said main radiating section having a substantially symmetric trapezoidal shape and said pin coupling section having a substantially rectangular shape, said pin coupling section being coupled to said feed pin;

a parasitic element mounted to said ground plane, said parasitic element comprising a second thin metal sheet and including a parasitic section and a shorting section, said parasitic section having a substantially symmetric trapezoidal shape and said shorting section comprising a thin strip extending orthogonally in a substantially upward direction from a central portion of an upper edge of said parasitic section;

a dielectric material separating said radiating element and said parasitic element; and an electrical connection coupling an upper tip portion of said shorting section of said parasitic element to a center portion of a top edge surface of said radiating element.

2. The folded mono-bow antenna of claim 1, wherein said dielectric material comprises air.

3. The folded mono-bow antenna of claim 1, wherein said dielectric material comprises a printed circuit board substrate having a dielectric constant less than or equal to 4.5.

4. The folded mono-bow antenna of claim 3, wherein said dielectric material comprises a printed circuit board substrate having a dielectric constant less than or equal to 3.3.

5. The folded mono-bow antenna of claim 3, wherein said radiating element and said parasitic element are formed on opposite sides of said printed circuit board substrate;

said pin coupling section of said radiating element has a height of substantially 0.145 inches and a width of substantially 0.200 inches and is separated from a base edge of said printed circuit board substrate by a distance of substantially 0.030 inches;

said top edge surface of said radiating element has a length of substantially 1.070 inches;

said parasitic section of said parasitic element has an upper base edge having a length of substantially 0.600 inches, a lower base edge having a length of substantially 0.175 inches, and a height of substantially 0.475 inches;

said shorting section of said parasitic element has a width of substantially 0.050 inches and a length of substantially 0.625 inches; and said printed circuit board substrate has a height of substantially 1.100 inches, a width of substantially 1.300 inches, and a thickness of substantially 0.062 inches.

6. The folded mono-bow antenna of claim 1, wherein said radiating element and said parasitic element are dimensioned for optimal transmission and reception at a frequency of 1710 to 1990 MHZ.

7. A folded mono-bow antenna for use in cellular or other wireless communications systems, comprising:

a ground plane having a hole formed therein;

a feed pin extending through said hole formed in said ground plane;

a radiating bowtie element coupled to said feed pin;

a parasitic element coupled to said ground plane;

a dielectric material separating said radiating bowtie element and said parasitic element; and a shorting element providing an electrical connection between an upper edge surface of said radiating bowtie element and an upper edge surface of said parasitic element.

8. The folded mono-bow antenna of claim 7, wherein said radiating bowtie element comprises a first thin metal sheet and includes a main radiating section and a pin coupling section, said main radiating section having a substantially symmetric trapezoidal shape and said pin coupling section having a substantially rectangular shape, said pin coupling section being coupled to said feed pin;

said parasitic element comprises a second thin metal sheet and has a substantially symmetric trapezoidal shape; and said shorting element comprises a thin metal strip which extends orthogonally from a central portion of said upper edge surface of said parasitic element to an electrical connection which couples said shorting element to a central portion of said upper edge surface of said radiating bowtie element.

9. The folded mono-bow antenna of claim 8, wherein said dielectric material comprises air.

10. The folded mono-bow antenna of claim 8, wherein said dielectric material comprises a printed circuit board substrate having a dielectric constant less than or equal to 4.5.

11. The folded mono-bow antenna of claim 8, wherein said dielectric material comprises a printed circuit board substrate having a dielectric constant less than or equal to 3.3.

12. The folded mono-bow antenna of claim 10, wherein said radiating bowtie element and said parasitic element are formed on opposite sides of said printed circuit board substrate;

said pin coupling section of said radiating element has a height of substantially 0.145 inches and a width of substantially 0.200 inches and is separated from a base edge of said printed circuit board substrate by a distance of substantially 0.030 inches;

said upper edge surface of said radiating bowtie element has a length of substantially 1.070 inches;

said parasitic element has an upper base edge surface having a length of substantially 0.600 inches, a lower base edge surface having a length of substantially 0.175 inches, and a height of substantially 0.475 inches;

said shorting element has a width of substantially 0.050 inches and a length of substantially 0.625 inches; and said printed circuit board substrate has a height of substantially 1.100 inches, a width of substantially 1.300 inches, and a thickness of substantially 0.062 inches.

13. The folded mono-bow antenna of claim 7, wherein said radiating bowtie element and said parasitic element are dimensioned for optimal transmission and reception at a frequency of 1710 to 1990 MHZ.

14. An antenna for use in cellular or other wireless communications systems, comprising:

a dielectric substrate having a first side and a second side;

a radiating bowtie element formed on said first side of said dielectric substrate;

a parasitic element formed on said second side of said dielectric substrate; and a shorting element formed on said second side and extending over a third side of said dielectric substrate, said shorting element providing an electrical connection between said radiating bowtie element and said parasitic element.

15. The antenna of claim 14, wherein said dielectric substrate comprises a printed circuit board substrate having a dielectric constant less than or equal to 4.5.

16. The antenna of claim 14, wherein said dielectric substrate comprises a printed circuit board substrate having a dielectric constant of substantially 3.0.

17. The antenna of claim 14 further comprising a ground plane having a hole formed therein; and a feed pin extending through said hole formed in said ground plane;

said radiating bowtie element being coupled to said feed pin, and said parasitic element being coupled to said ground plane.

18. The antenna of claim 17, wherein said radiating bowtie element comprises a first thin metal layer deposited on said first side of said substrate and includes a main radiating section and a pin coupling section, said main radiating section having a substantially symmetric trapezoidal shape and said pin coupling section having a substantially rectangular shape, said pin coupling section being coupled to said feed pin;

said parasitic element comprises a first portion of a second thin metal layer deposited on said second side of said substrate and has a substantially symmetric trapezoidal shape; and said shorting element comprises a second portion of said second metal layer deposited on said second side of said substrate, said second portion of said second metal layer forming a thin metal strip which extends orthogonally from a central portion of an upper edge surface of said parasitic element to an electrical connection which couples said shorting element to a central portion of an upper edge surface of said radiating bowtie element.

19. The antenna of claims 18, wherein said first and second metal layers comprise copper cladding.

20. The antenna of claim 19, wherein said radiating bowtie element, said parasitic element and said substrate are dimensioned to optimize transmission and reception at a frequency of 1710 to 1990 MHZ.

21. An antenna comprising:

a printed circuit board substrate having copper cladding deposited on a first side and a second side;

said copper cladding deposited on said first side of said printed circuit board substrate forming a bowtie radiating element;

a first portion of said copper cladding deposited on said second side of said printed circuit board substrate forming a parasitic element;

a second portion of said copper cladding deposited on said second side of said printed circuit board substrate forming a shorting element, said parasitic element and said shorting element comprising a unitary structure;

an electrical connection provided between said shorting element and said bowtie radiating element;

a ground plane having a hole formed therein; and a feed pin extending through said hole formed in said ground plane;

said bowtie radiating element being coupled to said feed pin, and said parasitic element being coupled to said ground plane.

22. The antenna of claim 21, wherein said ground plane comprises copper cladding deposited on a first surface of a second printed circuit board substrate, and wherein said parasitic element is coupled to said ground plane by means of a brass angle.

23. The antenna of claim 22, wherein a feed circuit is etched onto a second side of said second printed circuit board substrate, said feed circuit being coupled to said feed pin.

24. An antenna comprising:

a bowtie radiating element;

a parasitic element;

a shorting element, said shorting element having a proximal end electrically connected to said parasitic element and having a distal end electrically connected to said bowtie radiating element;

a dielectric material separating said bowtie radiating element and said parasitic element;

a ground plane having a hole formed therein;

a feed pin extending through said hole formed in said ground plane, said bowtie radiating element being coupled to said feed pin and said parasitic element being coupled to said ground plane; wherein said bowtie radiating element comprises a first thin metal sheet and includes a main radiating section and a pin coupling section, said main radiating section having a substantially symmetric trapezoidal shape, and said pin coupling section having a substantially rectangular shape and being coupled to said feed pin;

said parasitic element comprises a second thin metal sheet and has a substantially symmetric trapezoidal shape; and said shorting element comprises a thin metal strip which extends orthogonally from a central portion of an upper edge surface of said parasitic element to an electrical connection which couples said shorting element to a central portion of an upper edge surface of said bowtie radiating element.

25. An antenna array for use in cellular and other wireless communications systems, said antenna array comprising:

a pair of folded mono-bow antenna elements, each having a main radiating bowtie element and a parasitic element, said parasitic elements being mounted to a common ground plane, said main radiating bowtie elements being mounted to respective feed pins extending through respective holes formed in said common ground plane; and a 180° ring hybrid combiner/splitter circuit coupled to said feed pins;

wherein said folded mono-bow antenna elements each comprise a printed circuit board substrate having copper cladding deposited on a first side and a second side;

said copper cladding deposited on said first side of said printed circuit board substrate forming a bowtie radiating element;

a first portion of said copper cladding deposited on said second side of said printed circuit board substrate forming a parasitic element;

a second portion of said copper cladding deposited on said second side of said printed circuit board substrate forming a shorting element, said parasitic element and said shorting element comprising a unitary structure; and an electrical connection coupling said shorting element to said bowtie radiating element.

26. The antenna array of claim 25, wherein said ground plane comprises copper cladding deposited on a first side of a ground plane printed circuit board, and said 180° ring hybrid combiner/splitter circuit comprises copper cladding deposited on a second side of said ground plane printed circuit board.

27. The antenna array of claim 26 further comprising a housing, said housing including an aluminum base providing a mounting for said ground plane printed circuit board and a mounting for a pair of coax connectors, one of said coax connectors being coupled to a summing port of said 180° degree hybrid combiner/splitter circuit, and the other of said coax connectors being coupled to a difference port of said 180° degree hybrid combiner/splitter circuit; and a plastic cover adapted to be coupled to said aluminum base.

28. The antenna array of claim 26, wherein said feed pins are separated by a distance substantially equal to 3.3 inches, and the elements comprising said antenna array are dimensioned to enhance transmission and reception at a frequency of substantially 1920 MHZ.

29. The antenna array of claim 28, wherein said printed circuit board ground plane measures substantially 8.0 inches along a horizontal axis and substantially 6.0 inches along a vertical axis, said feed pins being mounted along said horizontal axis and being separated from a point of intersection of said vertical and horizontal axes by a distance of substantially 1.65 inches.

30. The antenna array of claim 29, wherein said printed circuit board substrate has a height of substantially 1.100 inches, a width of substantially 1.300 inches, a thickness of substantially 0.062 inches, and a dielectric constant of substantially 3.3;

said bowtie radiating element includes a main radiating section and a pin attachment section, said main radiating section having a substantially symmetric trapezoidal shape, a first base edge having a length of substantially 1.070 inches, a second base edge having a length of substantially 0.200 inches, and having a height of substantially 1.070 inches, and said pin attachment section having a substantially rectangular shape, having a superior edge coextensive and integral with said second base edge of said main radiating section, having a height of substantially 0.175 inches and a width of substantially 0.200 inches, and having an inferior edge separated by a distance of substantially 0.030 inches from a first ground plane mounting edge of said printed circuit board substrate;

said parasitic element has a substantially symmetric trapezoidal shape, a third base edge having a length of substantially 0.600 inches, a fourth base edge having a length of substantially 0.175 inches, and a height of substantially 0.475 inches, said forth base edge being integral with a second ground plane mounting edge of said printed circuit board substrate; and said shorting element extends substantially orthogonally from a central portion of said third base edge of said parasitic element and has a height of substantially 0.625 inches and a width of substantially 0.050 inches.

31. An antenna array for use in cellular and other wireless communications systems, said antenna array comprising:

four folded mono-bow antenna elements, each having a main radiating bowtie element and a parasitic element, said parasitic elements being mounted to a common ground plane, said main radiating bowtie elements each being mounted to a feed pin extending through a respective hole formed along a central axis of said common ground plane; and a butler matrix combiner circuit coupled to said feed pins;

wherein said folded mono-bow antenna elements each comprise a printed circuit board substrate having copper cladding deposited on a first side and a second side;

said copper cladding deposited on said first side of said printed circuit board substrate forming a bowtie radiating element;

a first portion of said copper cladding deposited on said second side of said printed circuit board substrate forming a parasitic element;

a second portion of said copper cladding deposited on said second side of said printed circuit board substrate forming a shorting element, said parasitic element and said shorting element comprising a unitary structure; and an electrical connection coupling said shorting element to said bowtie radiating element.

32. The antenna array of claim 31, wherein said ground plane comprises copper cladding deposited on a first side of a ground plane printed circuit board, and said butler matrix combiner circuit comprises copper cladding deposited on a second side of said ground plane printed circuit board.

33. The antenna array of claim 32 further comprising a housing, said housing including an aluminum base providing a mounting for said ground plane printed circuit board and a mounting for a set of four coax connectors, each of said coax connectors being coupled to a respective input port of said butler matrix combiner circuit; and a plastic cover adapted to be coupled to said aluminum base.

34. The antenna array of claim 33, wherein said feed pins are separated by a distance substantially equal to 3.3 inches, and the elements comprising said antenna array are dimensioned to enhance transmission and reception at a frequency of substantially 1920 MHZ.

35. The antenna array of claim 34, wherein said printed circuit board ground plane measures substantially 6.0 inches along a first axis and substantially 14.6 inches along a second axis, said second axis being orthogonal to said first axis, and said feed pins being mounted along said second axis.

36. The antenna array of claim 35, wherein said printed circuit board substrate of each of said folded mono-bow antenna elements has a height of substantially 1.100 inches, a width of substantially 1.300 inches, a thickness of substantially 0.062 inches, and a dielectric constant of substantially 3.3;

said bowtie radiating element of each of said folded mono-bow antenna elements includes a main radiating section and a pin attachment section, said main radiating section having a substantially symmetric trapezoidal shape, a first base edge having a length of substantially 1.070 inches, a second base edge having a length of substantially 0.200 inches, and having a height of substantially 1.070 inches, and said pin attachment section having a substantially rectangular shape, having a superior edge coextensive and integral with said second base edge of said main radiating section, having a height of substantially 0.175 inches and a width of substantially 0.200 inches, and having an inferior edge separated by a distance of substantially 0.030 inches from a first ground plane mounting edge of said printed circuit board substrate;

said parasitic element of each of said folded mono-bow antenna elements has a substantially symmetric trapezoidal shape, a third base edge having a length of substantially 0.600 inches, a fourth base edge having a length of substantially 0.175 inches, and a height of substantially 0.475 inches, said forth base edge being integral with a second ground plane mounting edge of said printed circuit board substrate; and said shorting element of each of said folded mono-bow antenna elements extends substantially orthogonally from a central portion of said third base edge of said parasitic element and has a height of substantially 0.625 inches and a width of substantially 0.050 inches.

37. An antenna array for use in cellular and other wireless communications systems, said antenna array comprising:

four antenna modules, each of said antenna modules comprising a pair of folded mono-bow antenna elements, each having a main radiating bowtie element and a parasitic element, said parasitic elements being mounted to a common ground plane, said main radiating bowtie elements each being mounted to a feed pin extending through a respective hole formed in said common ground plane; and a 0° summing circuit coupled to said feed pins; and a frame providing mountings for said four antenna modules, said frame generally comprising a parallel piped and having two pairs of parallel and opposing mounting surfaces, one of said four antenna modules being fixed to each respective mounting surface.

38. The antenna array of claim 37, wherein said folded mono-bow antenna elements each comprise:

a printed circuit board substrate having copper cladding deposited on a first side and a second side;

said copper cladding deposited on said first side of said printed circuit board substrate forming a bowtie radiating element;

a first portion of said copper cladding deposited on said second side of said printed circuit board substrate forming a parasitic element;

a second portion of said copper cladding deposited on said second side of said printed circuit board substrate forming a shorting element, said parasitic element and said shorting element comprising a unitary structure; and an electrical connection coupling said shorting element to said bowtie radiating element.

39. The antenna array of claim 38, wherein said ground plane of each of said antenna modules comprises copper cladding deposited on a first side of a ground plane printed circuit board, and said 0° summing circuit of each of said antenna modules comprises copper cladding deposited on a second side of said ground plane printed circuit board.

40. The antenna array of claim 39, wherein said feed pins of each antenna module are separated by a distance substantially equal to 3.3 inches, and said folded mono-bow antenna elements of each antenna module are dimensioned to enhance transmission and reception at a frequency of substantially 1920 MHZ.

41. The antenna array of claim 40, wherein said printed circuit board ground plane of each antenna module measures substantially 8.0 inches along a first axis and substantially 3.0 inches along a second axis, said second axis being orthogonal to said first axis, and said feed pins being mounted along said first axis and being separated from a point of intersection of said first and second axes by a distance of substantially 1.65 inches.

42. The antenna array of claim 41, wherein said printed circuit board substrate of each antenna module has a length of substantially 1.100 inches, a width of substantially 1.300 inches, a thickness of substantially 0.062 inches, and a dielectric constant of substantially 3.3;

said bowtie radiating element of each folded mono-bow antenna element includes a main radiating section and a pin attachment section, said main radiating section having a substantially symmetric trapezoidal shape, a first base edge having a length of substantially 1.070 inches, a second base edge having a length of substantially 0.200 inches, and having a height of substantially 1.070 inches, and said pin attachment section having a substantially rectangular shape, having a superior edge coextensive and integral with said second base edge of said main radiating section, having a height of substantially 0.175 inches and a width of substantially 0.200 inches, and having an inferior edge separated by a distance of substantially 0.030 inches from a first ground plane mounting edge of said printed circuit board substrate;

said parasitic element of each folded mono-bow antenna element has a substantially symmetric trapezoidal shape, a third base edge having a length of substantially 0.600 inches, a fourth base edge having a length of substantially 0.175 inches, and a height of substantially 0.475 inches, said forth base edge being integral with a second ground plane mounting edge of said printed circuit board substrate; and said shorting element of each folded mono-bow antenna element extends substantially orthogonally from a central portion of said third base edge of said parasitic element and has a height of substantially 0.625 inches and a width of substantially 0.050 inches.

43. An antenna array for use in cellular and other wireless communications systems, said antenna array comprising:

four antenna modules, each of said antenna modules comprising a pair of folded mono-bow antenna elements, each having a main radiating bowtie element and a parasitic element, said parasitic elements being mounted to a common ground plane element, said main radiating bowtie elements each being mounted to a feed pin extending through a respective hole formed in said common ground plane element; and a 180° ring hybrid combiner/splitter circuit coupled to said feed pins; wherein said antenna modules are arranged such that selected pairs of said common ground plane elements form parallel and opposing surfaces, and such that adjacent pairs of said ground plane elements have an orthogonal relationship to one another.

44. An antenna array for use in cellular and other wireless communications systems, said antenna array comprising:

four antenna modules, each of said antenna modules comprising a pair of monopole antenna elements, each of said antenna elements having a radiation pattern which is substantially omnidirectional in a horizontal plane, and each of said antenna elements being mounted to a feed pin extending through a respective hole formed in said common ground plane element; and a 180° ring hybrid combiner/splitter circuit coupled to said feed pins; wherein said antenna modules are arranged such that respective pairs of said common ground plane elements form parallel and opposing surfaces, and such that adjacent pairs of said ground plane elements have an orthogonal relationship to one another.

45. An antenna array for use in cellular and other wireless communications systems, said array comprising:

a first and second coplanar ground plane elements;

a first folded mono-bow antenna element mounted to said first ground plane element and extending orthogonally from a first surface of said first ground plane element;

a second folded mono-bow antenna element mounted to said second ground plane element and extending orthogonally from an opposite surface of said second ground plane element; and a 180° hybrid combiner network coupled to said first and second folded mono-bow antenna elements.

46. An antenna array for use in cellular and other wireless communication systems, said array comprising:

a pair of folded mono-bow antenna elements and a 180° hybrid combiner network coupled to said folded mono-bow antenna elements;

said folded mono-bow antenna elements being oriented along a vertical axis, separated by substantially one half of a selected wavelength, and oriented in contra-direction to one another.

* * * * *